US007311267B2

(12) United States Patent
Griese et al.

(10) Patent No.: US 7,311,267 B2
(45) Date of Patent: Dec. 25, 2007

(54) PRODUCT DISPENSER AND CARRIER

(75) Inventors: Gregory G. Griese, Hudson, WI (US); Steven E. Lentsch, St. Paul, MN (US)

(73) Assignee: Ecolab, Inc., St. Paul, MN (US)

( * ) Notice: Subject to any disclaimer, the term of this patent is extended or adjusted under 35 U.S.C. 154(b) by 266 days.

(21) Appl. No.: 11/074,161

(22) Filed: Mar. 7, 2005

(65) Prior Publication Data

US 2005/0150974 A1 Jul. 14, 2005

Related U.S. Application Data

(60) Division of application No. 10/848,333, filed on May 17, 2004, now Pat. No. 6,908,041, which is a continuation of application No. 10/411,062, filed on Apr. 9, 2003, now Pat. No. 6,779,740, which is a continuation-in-part of application No. 10/121,440, filed on Apr. 10, 2002, now Pat. No. 6,883,723.

(51) Int. Cl.

| | |
|---|---|
| ***A61L 9/04*** | (2006.01) |
| ***A24F 25/00*** | (2006.01) |
| ***F26B 11/02*** | (2006.01) |
| ***F26B 3/00*** | (2006.01) |

(52) U.S. Cl. ..... 239/43; 34/444; 34/595; 34/139

(58) Field of Classification Search ..... 239/43; 34/87, 597, 444, 595, 139
See application file for complete search history.

(56) References Cited

U.S. PATENT DOCUMENTS

| | | | | |
|---|---|---|---|---|
| 2,851,791 | A * | 9/1958 | Olthuis | 34/90 |
| 3,442,692 | A | 5/1969 | Gaiser | 117/120 |
| 3,676,199 | A | 7/1972 | Hewitt et al. | 117/109 |
| 3,686,025 | A | 8/1972 | Morton | 117/140 |
| 3,701,202 | A * | 10/1972 | Compa et al. | 34/72 |
| 3,804,330 | A | 4/1974 | Miller et al. | 239/34 |
| 3,844,478 | A | 10/1974 | Davis | 239/57 |
| 3,870,145 | A * | 3/1975 | Mizuno | 206/0.5 |
| 3,948,387 | A | 4/1976 | Haertle | 206/84 |
| 3,967,008 | A | 6/1976 | Mizuno et al. | 427/242 |
| 4,004,685 | A | 1/1977 | Mizuno et al. | 206/0.5 |
| 4,014,432 | A | 3/1977 | Clothier et al. | 206/0.5 |
| 4,098,937 | A | 7/1978 | Mizuno et al. | 428/68 |
| 4,105,813 | A | 8/1978 | Mizuno | 428/76 |
| 4,254,139 | A | 3/1981 | Hendrickson et al. | |
| 4,567,675 | A | 2/1986 | Rennie | 36/40 |

(Continued)

FOREIGN PATENT DOCUMENTS

| | | |
|---|---|---|
| DE | 2350574 | 4/1974 |

(Continued)

*Primary Examiner*—William C Doerrler
(74) *Attorney, Agent, or Firm*—IPLM Group, P.A.

(57) ABSTRACT

A product dispenser and carrier (10, 110, 210, 310, 410, 510, 610) for attachment to a surface such as a dryer fin includes a plate member (11, 111, 211, 311, 411, 511) and a product carrier (21, 121, 221, 321, 421, 521). The plate member (11, 111, 211, 311, 411, 511) attaches to the surface and the product carrier (21, 121, 221, 321, 421, 521) releasably attaches to the plate member (11, 111, 211, 311, 411, 511). Product (31, 131, 431, 531) is operatively connected to the product carrier (21, 121, 221, 321, 421, 521).

13 Claims, 18 Drawing Sheets

U.S. PATENT DOCUMENTS

| | | | | |
|---|---|---|---|---|
| 4,570,888 | A * | 2/1986 | Evans | 248/205.1 |
| 4,677,760 | A * | 7/1987 | St. Louis | 34/90 |
| 4,753,389 | A | 6/1988 | Davis | |
| 4,840,773 | A | 6/1989 | Wade | |
| 4,891,890 | A | 1/1990 | Church | 34/12 |
| 5,020,240 | A | 6/1991 | Lee | 34/60 |
| 5,069,231 | A | 12/1991 | Rutherford | |
| 5,440,976 | A | 8/1995 | Giuliano et al. | |
| 5,658,651 | A | 8/1997 | Smith et al. | 442/59 |
| 5,787,606 | A | 8/1998 | Bokholdt | 34/527 |
| 5,869,410 | A | 2/1999 | Smith et al. | 442/333 |
| 5,943,816 | A | 8/1999 | Hyatt et al. | |
| 5,966,831 | A | 10/1999 | Anderson | 34/60 |
| 6,006,472 | A | 12/1999 | Holtkamp, Jr. | |
| 6,110,886 | A | 8/2000 | Scepanski | |
| 6,238,736 | B1 | 5/2001 | Smith et al. | 427/242 |
| 6,254,932 | B1 | 7/2001 | Smith et al. | 427/242 |
| 6,305,046 | B1 * | 10/2001 | Kingry et al. | 15/231 |
| 6,779,740 | B1 | 8/2004 | Lentsch et al. | |
| 2002/0108969 | A1 * | 8/2002 | Rodd et al. | 222/209 |
| 2003/0024943 | A1 | 2/2003 | MacDonald | |

FOREIGN PATENT DOCUMENTS

| | | |
|---|---|---|
| GB | 1 383 749 | 2/1975 |

* cited by examiner

FIG. 8
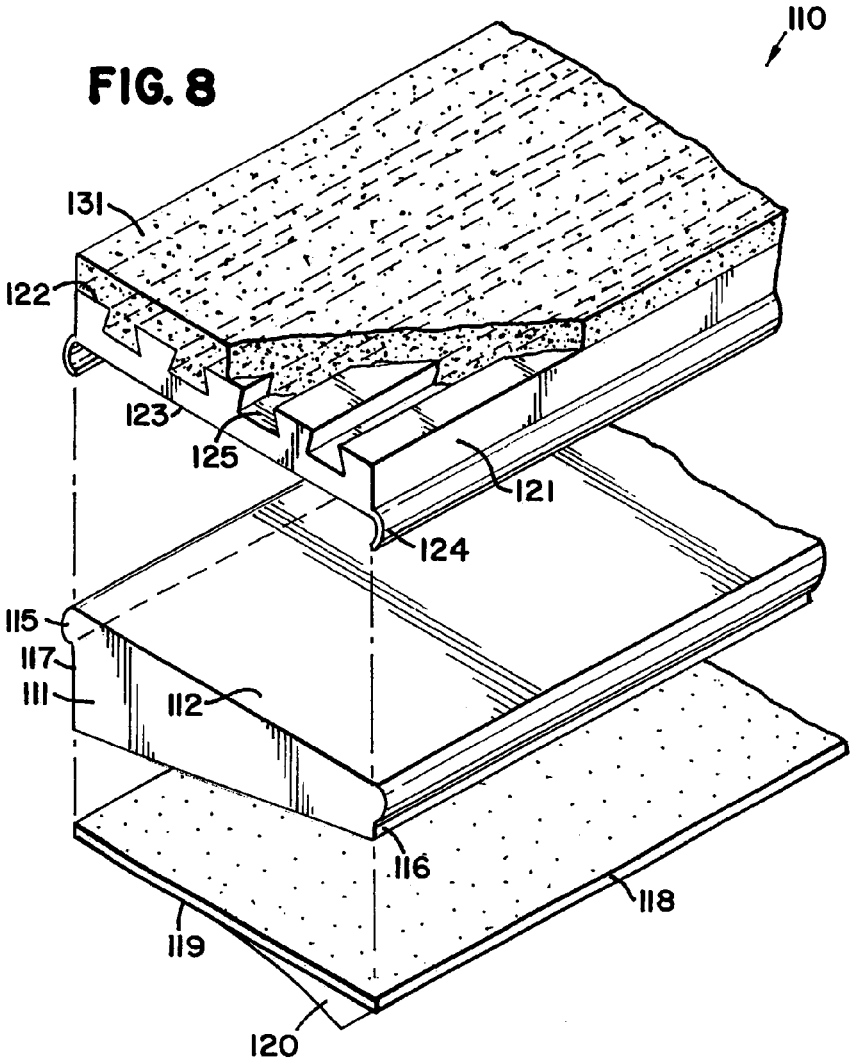
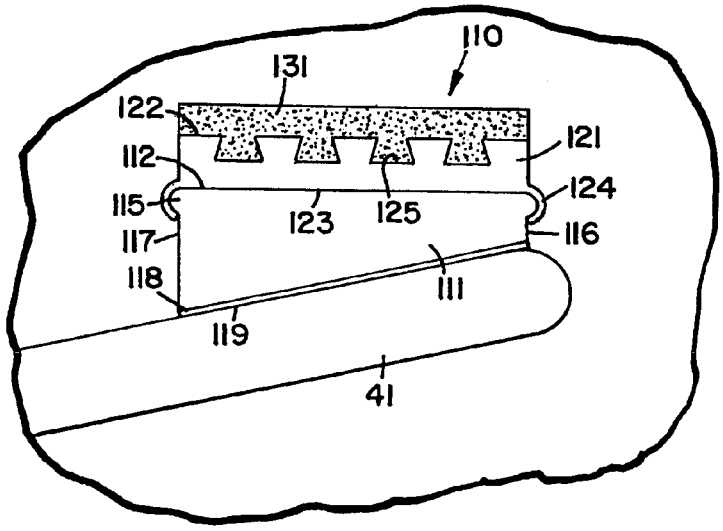
FIG. 9

FIG. 23
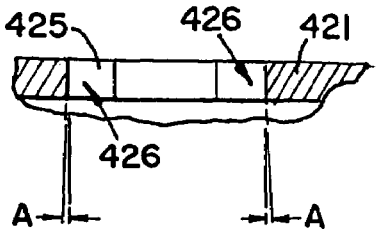
FIG. 24A
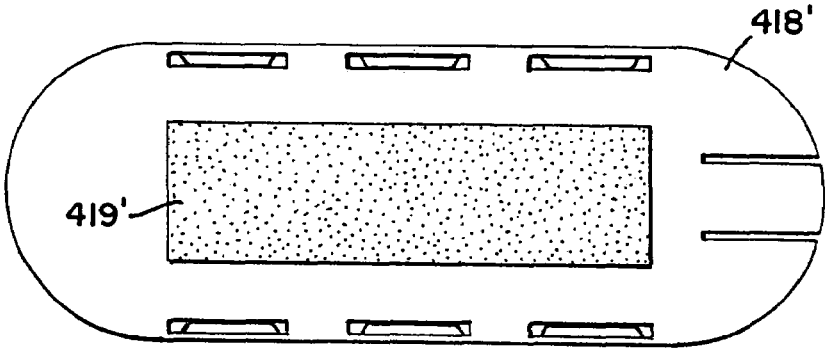
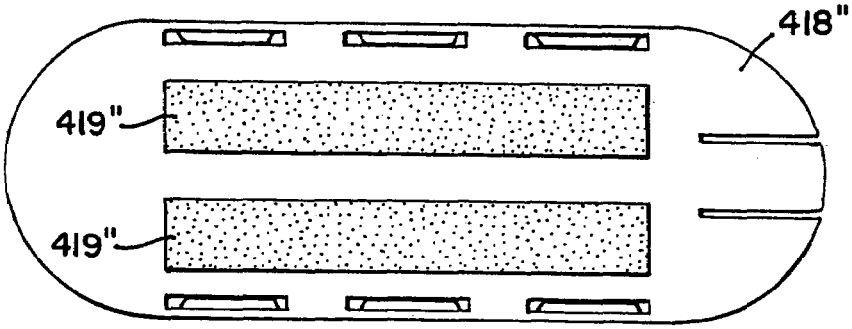
FIG. 24B

PRODUCT DISPENSER AND CARRIER

This application is a continuation of U.S. patent application Ser. No. 10/848,333, filed May 17, 2004 now U.S. Pat. No. 6,908,041, which is a continuation of U.S. patent application Ser. No. 10/411,062, filed Apr. 9, 2003, now U.S. Pat. No. 6,779,740, which is a continuation-in-part of U.S. patent application Ser. No. 10/121,440, filed Apr. 10, 2002 now U.S. Pat. No. 6,883,723.

BACKGROUND OF THE INVENTION

1. Field of the Invention

The present invention relates to a product dispenser and carrier, and more particularly, the present invention relates to a product dispenser and carrier for dispensing a solid fabric conditioner inside a dryer.

2. Description of the Prior Art

Laundry additives are commonly applied to laundry via a liquid either prior to or during the wash cycle or via a treated sheet during the dryer cycle. Laundry may be pre-treated prior to the wash cycle, or the liquid additive mixes with the water during the wash cycle to contact the laundry. The treated sheet tumbles around in the dryer during the dryer cycle to contact the laundry. For best results, either another dose of the liquid or a new treated sheet must be applied each time. Although treated sheets may be used more than one time, they become much less effective with each subsequent cycle. Therefore, using a new treated sheet each time works best to have consistent, effective results on the laundry. In addition, other types of laundry products can be applied prior to placing the laundry in either the washer and/or the dryer. For example, pre-treatment products in either a liquid or a semi-solid form may be applied to the laundry. However, again these products must be applied to the laundry each time before the appropriate cycle.

SUMMARY OF THE INVENTION

In a preferred embodiment dispenser for attachment to a surface, a plate member has a front side, a back side, and an attachment member. A product carrier has a mating member, a first side, and a second side and is configured and arranged to engage the attachment member thereby releasably connecting the plate member and the product carrier, whereby the product carrier is replaceable. A connecting member is operatively connected to the back side of the plate member, and the connecting member operatively connects the plate member to the surface. A solid product is operatively connected to the product carrier, wherein a substantial portion of the solid product extends from the first side of the product carrier away from the plate member and the second side of the product carrier faces the plate member.

In other preferred embodiment dispenser for dispensing a fabric conditioner in a dryer, the dryer having an inner surface, a plate member has a front side and a back side. The back side has means for operatively connecting the back side to the inner surface. An attachment member is operatively connected to the plate member. A product carrier has a mating member, a first side, and a second side, and the mating member is configured and arranged to engage the attachment member thereby releasably connecting the plate member and the product carrier, which carries the fabric conditioner.

In another preferred embodiment product dispenser for attachment to a surface, a plate member includes a front side and a back side. An attachment member is operatively connected to the plate member. An adhesive is operatively connected to the back side of the plate member for connecting the plate member to the surface. A product carrier includes a mating member, a first side, and a second side. The mating member is configured and arranged to engage the attachment member thereby releasably connecting the plate member and the product carrier. The product carrier carries a solid product, wherein a substantial portion of the solid product extends from the first side away from the plate member and the second side faces the front side of the plate member.

In a preferred embodiment method for dispensing a product, a plate member is attached to a surface. The plate member has a front side, a back side, and an attachment member. The back side includes an adhesive for connecting the back side to the surface. A carrier is attached to the plate member. The carrier has a mating member, a first side and a second side. The mating member is configured and arranged to releasably engage the attachment member, and the carrier carries the product and is replaceable.

In another preferred embodiment method for dispensing a fabric conditioner in a dryer, the dryer having an inner surface, a plate member is attached to the inner surface of the dryer. The plate member has a front side, a back side, and an attachment member. The back side has an adhesive, which connects the back side to the inner surface of the dryer. A product carrier is then attached to the front side of the plate member. The product carrier has a mating member, a first side, and a second side. The mating member is configured and arranged to engage the attachment member thereby releasably connecting the plate member and the product carrier. The product carrier carries the fabric conditioner and is replaceable, wherein a substantial portion of the fabric conditioner extends from the first side of the product carrier away from the plate member and the second side of the product carrier faces the front side of the plate member. The fabric conditioner is allowed to become depleted after repeated use in the dryer, and the product carrier is then removed from the plate member. A second product carrier carrying a second fabric conditioner is then attached to the plate member.

In another preferred embodiment dispenser for mounting on a surface, a mount has a top side with a flange and a bottom side. A product carrier has a first side and a second side, and the second side has legs extending therefrom. The legs are configured and arranged to engage the flange thereby releasably connecting the product carrier to the mount. A solid product is operatively connected to the first side of the product carrier.

In another preferred embodiment dispensing device for attachment to a surface, a dispenser has a mount and a carrier. The mount is operatively connected to the surface and the carrier is operatively connected to the mount. A product is cast onto the carrier opposite the mount, and the product is disposed on the dispenser at an angle relative to the surface to which the dispenser is operatively connected.

In a preferred embodiment method of dispensing a fabric conditioner in a dryer, a fabric conditioner is cast onto a product carrier, and the fabric conditioner has rounded edges. A plate member is attached to a fin of a dryer, and the product carrier is attached to the plate member. The dryer is allowed to run through a dryer cycle. A consistent, optimum dose of said fabric conditioner is dispensed from an initial cycle to a final cycle until said fabric conditioner has become depleted.

In a preferred embodiment dispenser for attachment to a surface, a plate member has a front side, a back side, and an attachment member. A product carrier has a mating member configured and arranged to engage the attachment member thereby releasably connecting the plate member and the product carrier, and the product carrier is replaceable. A solid product is operatively connected to the product carrier.

In a preferred embodiment dispenser for attachment to a surface, a plate member has a front side, a back side, and an attachment member. A product carrier has a mating member, a first side, and a second side. The mating member is configured and arranged to engage the attachment member thereby releasably connecting the plate member and the product carrier, whereby the product carrier is replaceable. A magnet is operatively connected to the back side of the plate member, and the magnet operatively connects the plate member to the surface. A solid product is operatively connected to the product carrier, wherein the solid product extends from the first side of the product carrier away from the front side of the plate member and the second side of the product carrier faces the front side of the plate member.

In a preferred embodiment dispensing system for dispensing a fabric conditioner, a dryer has an inner surface and a plate member is incorporated into the inner surface. The plate member has a front side, and an attachment member is operatively connected to the front side of the plate member. A product carrier has a mating member configured and arranged to engage the attachment member thereby releasably connecting the plate member and the product carrier. The product carrier carries the fabric conditioner.

In a preferred embodiment product dispenser for attachment to a surface, a plate member includes a front side and a back side and an attachment member is operatively connected to the plate member. A connecting member is operatively connected to the back side of the plate member for connecting the plate member to the surface. A product carrier includes a mating member, a first side, and a second side. The mating member is configured and arranged to engage the attachment member thereby releasably connecting the plate member and the product carrier. A plurality of tapered apertures taper outward from the first side to the second side of the product carrier, and the tapered apertures have a smaller diameter on the first side and a larger diameter on the second side. The product carrier carries a solid product and the solid product extends into the tapered apertures. The tapered apertures hold the solid product onto the product carrier, and the solid product extends from the first side of the product carrier away from the front side of the plate member and the second side of the product carrier faces the front side of the plate member.

In a preferred embodiment dispenser for attachment to a surface, a plate member havs a front side, a back side, and an attachment member and a product carrier has a first side, a second side, a length, and a mating member. The mating member is configured and arranged to engage the attachment member thereby releasably connecting the plate member and the product carrier, whereby the product carrier is replaceable. A plurality of apertures disposed on the product carrier in a nonlinear arrangement extend from the first side to the second side of the product carrier. A reinforcement member extends along the length of the product carrier in a nonlinear arrangement without interfering with the plurality of apertures.

BRIEF DESCRIPTION OF THE DRAWINGS

FIG. 8 is an exploded top perspective view of another embodiment product dispenser and carrier constructed according to the principles of the present invention;

FIG. 9 is an end view of the product dispenser and carrier shown in FIG. 8 attached to a dryer fin;

FIG. 23 is a cross sectional view of an aperture taken along the lines 23-23 in FIG. 13;

FIG. 24*a* is a back view of a plate member of the product dispenser and carrier shown in FIG. 13;

FIG. 24*b* is a back view of another embodiment plate member of the product dispenser and carrier shown in FIG. 13;

DETAILED DESCRIPTION OF THE PREFERRED EMBODIMENT

Figure 1:
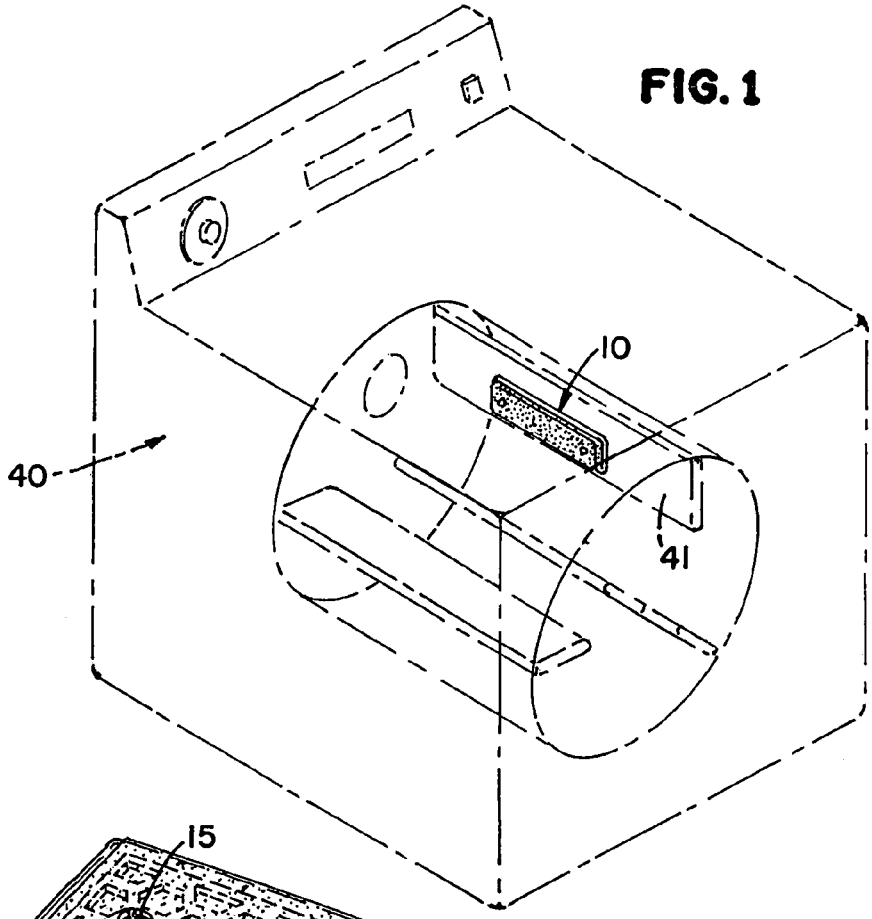
FIG. 1 shows a product dispenser and carrier constructed according to the principles of the present invention attached to a dryer fin.

Product dispensers and carriers constructed according to the principles of the present invention are designated by the numerals 10, 110, 210, 310, 410, 510, and 610 in the drawings.

Figure 2:
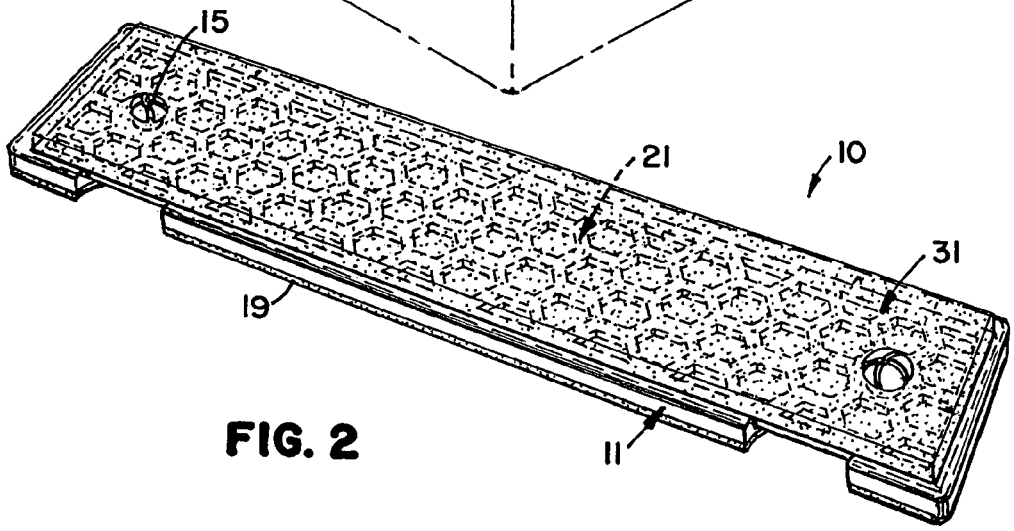
FIG. 2 is a top perspective view of the product dispenser and carrier shown in FIG. 1.
Figure 3:
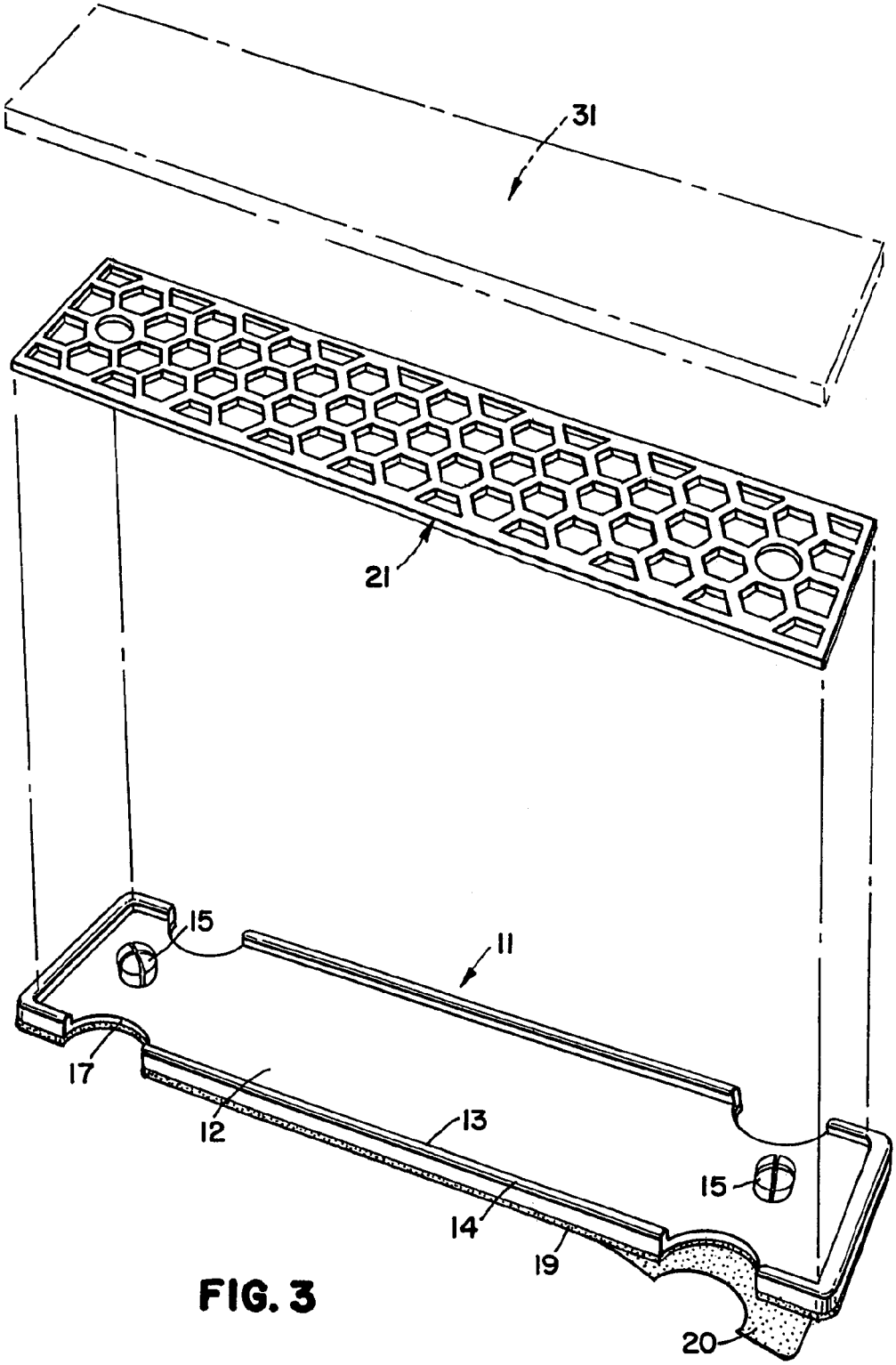
FIG. 3 is an exploded top perspective view of the product dispenser and carrier shown in FIG. 1.

In one preferred embodiment, the product dispenser and carrier 10 includes a plate member 11 and a product carrier 21, which carries a product 31. An assembled product dispenser and carrier 10 is shown in FIG. 2, and an exploded view of the product dispenser and carrier 10 is shown in FIG. 3. Generally, the product carrier 21 is operatively connected to the plate member 11, which may be attached to a surface such as a fin 41 of a dryer 40, as shown in FIG. 1, to dispense the product 31 such as a solid fabric conditioner. Although the invention is described for use with fabric softeners, other products such as sanitizers, water repellants, deodorizers, bleaches, soil repellants, due-transfer inhibitors, fiber protecting polymers, fiber smoothers, UV light absorbers, anti-wrinkle agents, and etc. could also be used. Therefore, the present invention is not limited to use with fabric softeners.

Figure 10:
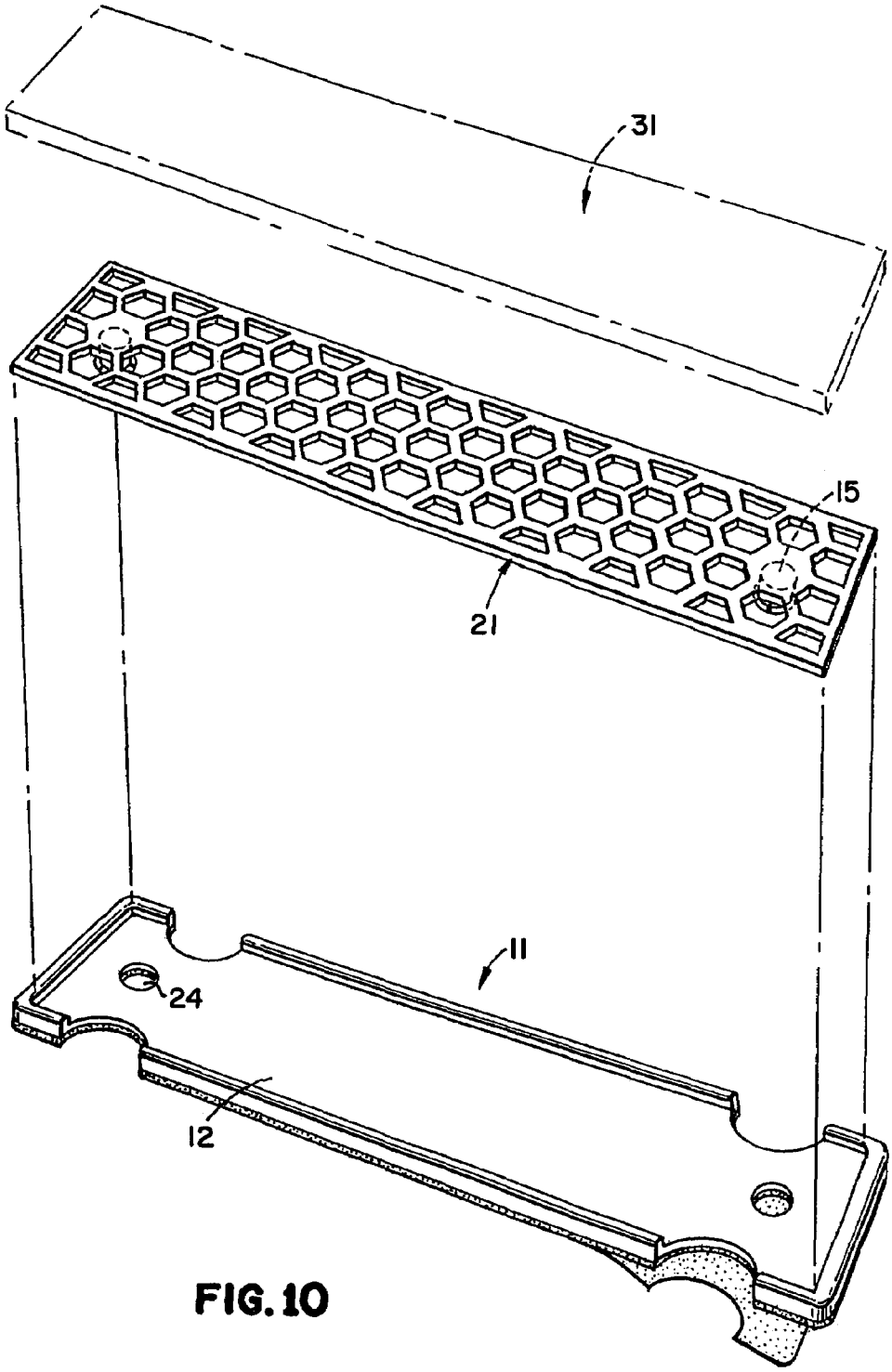
FIG. 10 is an exploded top perspective view of another embodiment product dispenser and carrier constructed according to the principles of the present invention.
Figure 11A:
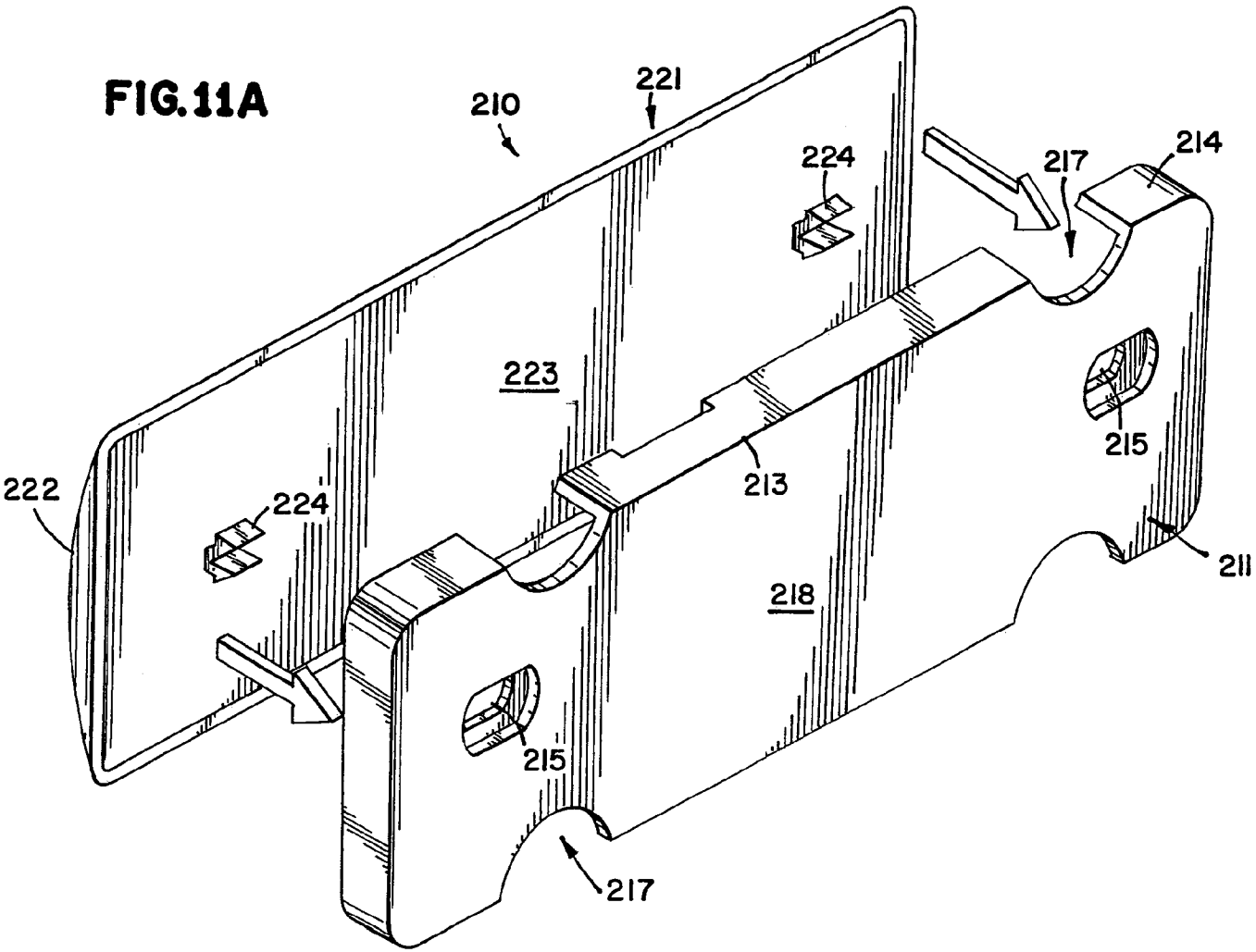
FIG. 11*a* is an exploded bottom perspective view of another embodiment product dispenser and carrier constructed according to the principles of the present invention.
Figure 11B:
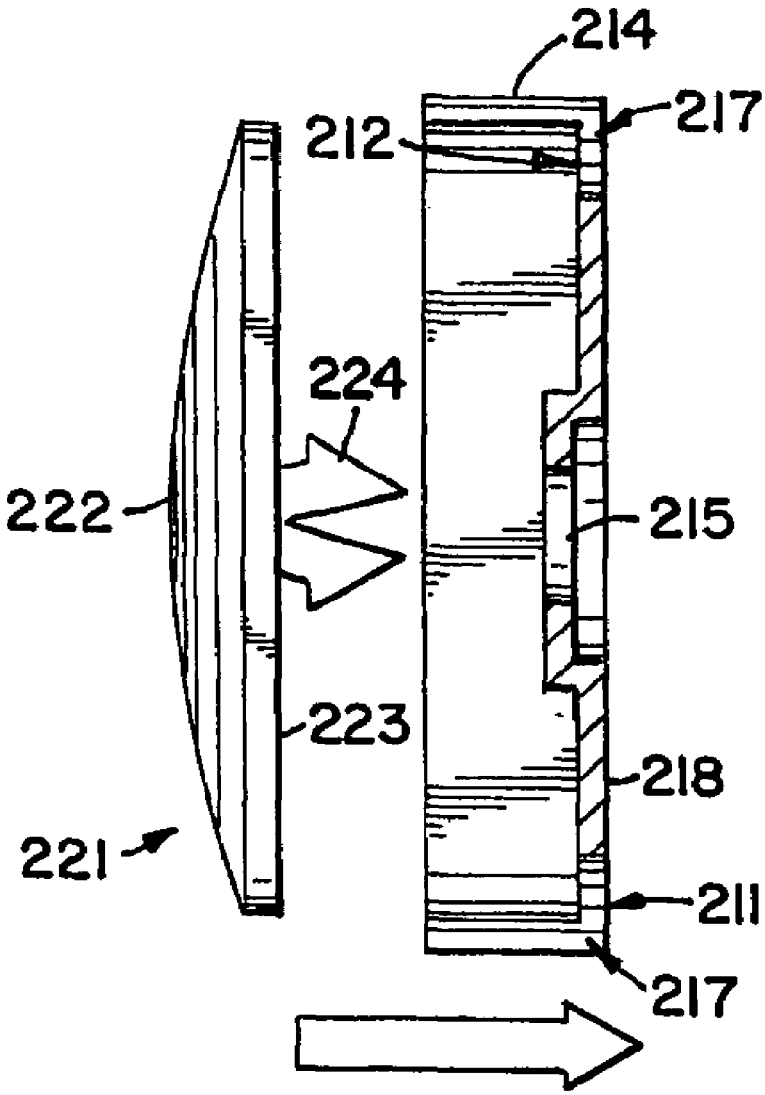
FIG. 11*b* is an exploded side view of the product dispenser and carrier shown in FIG. 11*a;*

The plate member 11 is rectangular in shape having dimensions of approximately 9⅜ inches long by 2⅜ inches wide by ¼ inch thick and is made of a high melt point plastic such as nylon or high impact polypropylene. It is recognized that other suitable high melt point plastics known in the art may also be used. The plate member 11 includes a front side 12 and a back side 18. The front side 12 has a perimeter 13, which is surrounded by a rail member 14. The rail member 14 protrudes slightly outward from the front side 12 and has rounded edges thereby creating a recessed area to accept and border the product carrier 21 within the rail member 14. The front side 12 also includes an attachment member 15, which in the preferred embodiment is a pair of hole plugs to provide releasable attachment means for operatively connecting the product carrier 21 to the plate member 11. One hole plug is located on each end of the plate member 11 and is configured and arranged to accommodate holes in the product carrier 21. The hole plugs are cylindrical and mushroom shaped with two slits at right angles to each other thereby dividing the hole plugs into four equal segments. The four segments allow the hole plugs to releasably engage the holes. As the hole plugs are pushed into the holes, the segments are brought closer together allowing the holes to snap down over the mushroom portion, which then protrudes from the holes and the segments are allowed to spread apart again thereby holding the product carrier 21 onto the plate member 11. The hole plugs could also be square in shape with an arrow head and a slit dividing the hole plug in two segments parallel to the arrow head, as shown in FIGS. 11*a* and 11*b*. To release the product carrier 21 from the hole plugs, the holes are brought over the mushroom portion of the hole plugs thereby bringing the segments together to allow the holes to pull over the mushroom portion and be released. The hole plugs may be molded as part of the plate member 11. However, the hole plugs 15 may also be molded as part of the product carrier 21 and engage holes 24 in the plate member 11 as shown in FIG. 10. Alternatively, the hole plugs could be a purchased part such as those commercially available from ITW Fastex, part number 207-241141-00 rather than molding them as part of the plate member 11 or product carrier 21. Although hole plugs and holes are shown in the preferred embodiment, it is understood that other attachment means such as snaps, VELCRO®, and other means known in the art may be used to connect the product carrier 21 to the plate member 11. The plate member 11 also includes indentations 17, which allow easy removal of the product carrier 21 when the product 31 has been depleted and the product carrier 21 must be replaced with a new product carrier, on each side near each end of the plate member 11. The indentations are sized and arranged to make removal of the product carrier 21 easy with one's fingers. Also, the product carrier 21 may simply be removed if dispensing of the particular product is not desired.

The back side 18 of the plate member 11 includes an adhesive 19, which is used to operatively connect the plate member 11 to a surface. The adhesive 19 in the preferred embodiment is a double-sided foam back tape manufactured by 3M, part number 4084, having a paper backing 20. The paper backing 20 may be removed when it is desired to attach the plate member 11 to a surface. Again, it is understood that other connecting means may be used to operatively connect the plate member 11 to a surface such as using VELCRO®, screws, magnets, and other means well known in the art.

Figure 4:
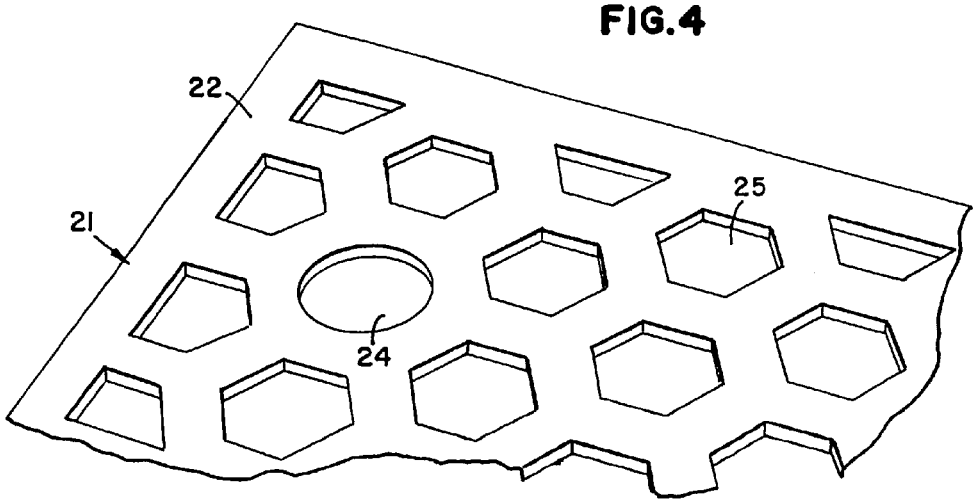
FIG. 4 is a top perspective view of a portion of the product carrier shown in FIG. 3.
Figure 6:
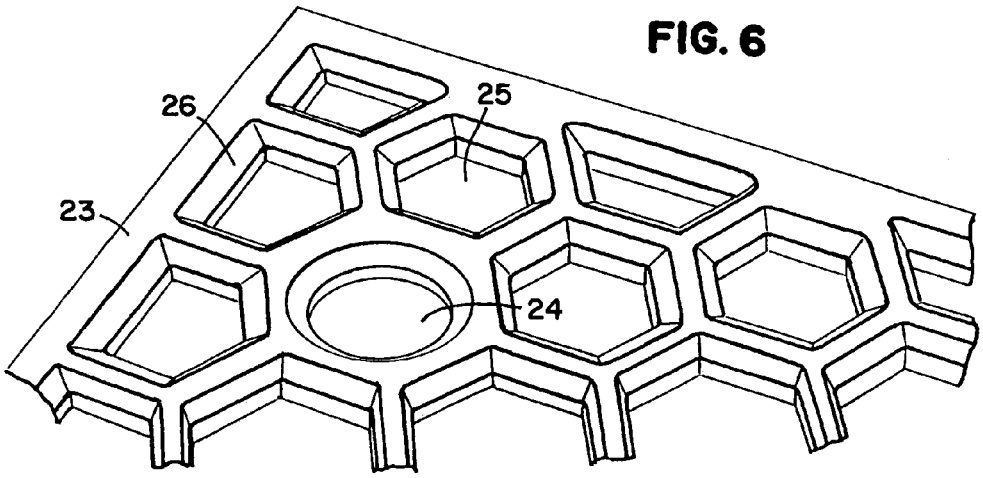
FIG. 6 is a bottom perspective view of a portion of the product carrier shown in FIG. 3.

The product carrier 21 is also rectangular in shape and is configured and arranged to fit within the rail 14 of the plate member 11. The product carrier 21 is approximately 9 inches long by 2 inches wide by ⅛ inch thick and is made of a high melt point plastic. The product carrier includes a first side 22 and a second side 23, which are shown in FIGS. 4 and 6, respectively. The first side 22 faces outward from the plate member 11 while the second side 23 faces the front side 12 of the plate member 11. A mating member 24, which engages the attachment member 15, is also included in the product carrier 21. In the preferred embodiment, the mating member 24 is a pair of holes having diameters of approximately ⅜ inch, one hole located on each side of the product carrier 21 and configured and arranged to releasably engage each of the hole plugs in the plate member 11 as described above. The holes could also be oval in shape to accommodate either round or square hole plugs, as shown in FIG. 11*a*, and the oval shape would ensure that the hole plugs would fit should any shrinkage of the holes occur from exposure to the heat of the dryer. A plurality of apertures 25 approximately ⅜ inch in diameter are arranged on the product carrier, and in the preferred embodiment, the plurality of apertures 25 are hexagon shaped and are arranged in a nonlinear, honeycomb fashion. This nonlinear, honeycomb arrangement of the apertures 25 strengthens the product carrier 21 and prevents the product 31 from breaking and shearing from the product carrier 21. In addition, one preferred embodiment apertures 25 are countersunk or back beveled on the second side 23 to form a rivet like structure when the product 31 is applied to the product carrier 21. The apertures 25 may also be tapered from the first side 22 to the second side 23 rather than being countersunk. The countersunk portion 26 of apertures 25 allows the product 31 to be securely attached to the product carrier 21, as would a tapered aperture, and this is described more fully below. The product carrier 21 containing product 31 is disposable and replaceable once the product 31 has been depleted on the product carrier 21.

Figure 5:
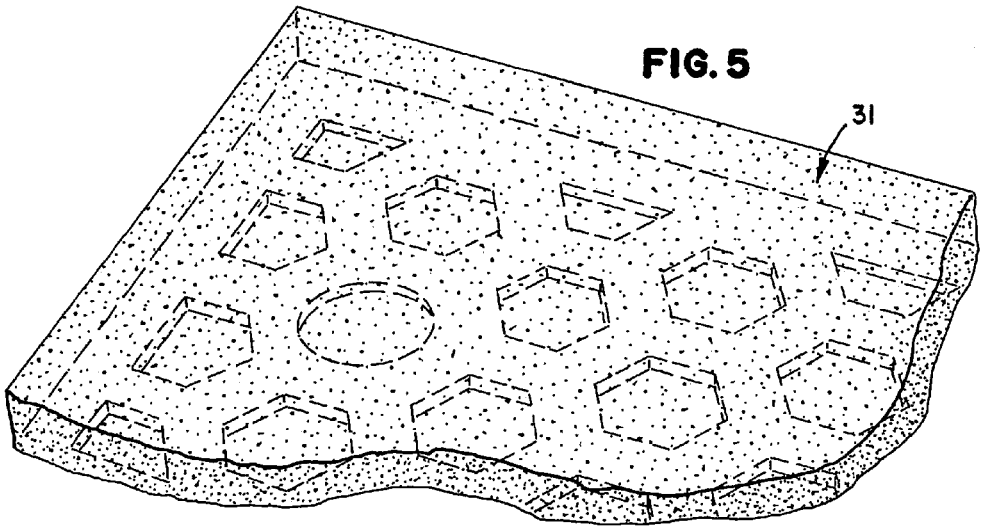
FIG. 5 is a top perspective view of the portion of the product carrier shown in FIG. 4 with product on the product carrier.
Figure 7:
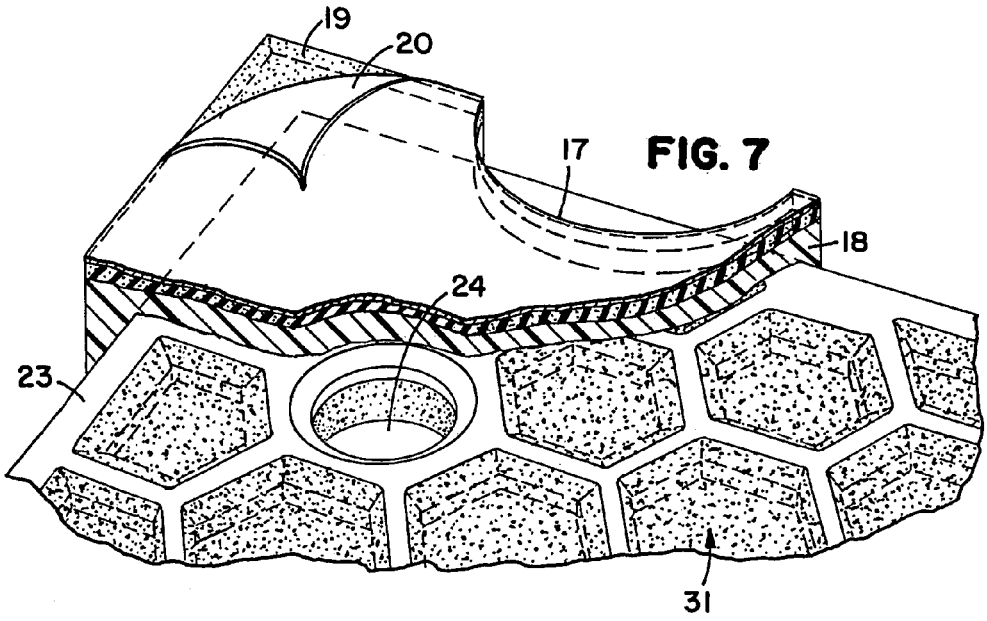
FIG. 7 is a bottom perspective view of the portion of the product carrier shown in FIG. 6 with product on the product carrier and the product dispenser attached thereto.

The product 31 is preferably a solid product that is cast or extruded onto the first side 22 of the product carrier 21, as shown in FIG. 5. However, the product 31 could also be glued, attached with VELCRO®, or otherwise operatively connected by means well known in the art to the product carrier 21. As the product 31 is being cast or extruded onto the first side 22 of the product carrier 21, the product 31 fills in the apertures 25, and the countersunk portions 26 of apertures 25 allow the product 31 to fan or spread out proximate the second side 23 of the product carrier 21. When the product 31 solidifies onto the product carrier 21, this fanning or spreading out of the product 31 in the countersunk portions 26 proximate the second side 23 holds the product 31 onto the first side 22 of the product carrier 21, as shown in FIG. 7. A substantial portion of the product 31 extends from the first side 22 of the product carrier 21 away from the plate member 11 and the second side 23 of the product carrier 21 faces the front side 12 of the plate member 11. The substantial portion being at least about 85% of the product 31 on the side of the carrier 21 from which the product 31 is dispensed. The product 31 extends approximately ¾ inch from the first side 22 of the product carrier 21. The preferred embodiment utilizes a solid fabric softener as the product 31 that is fixedly cast or extruded onto the product carrier 21. The solid fabric softener is described in U.S. patent application Ser. No. 10/120,891, filed Apr. 10, 2002, entitled Fabric Softener Composition and Methods for Manufacturing and Using, which is incorporated by reference herein.

Figure 20:
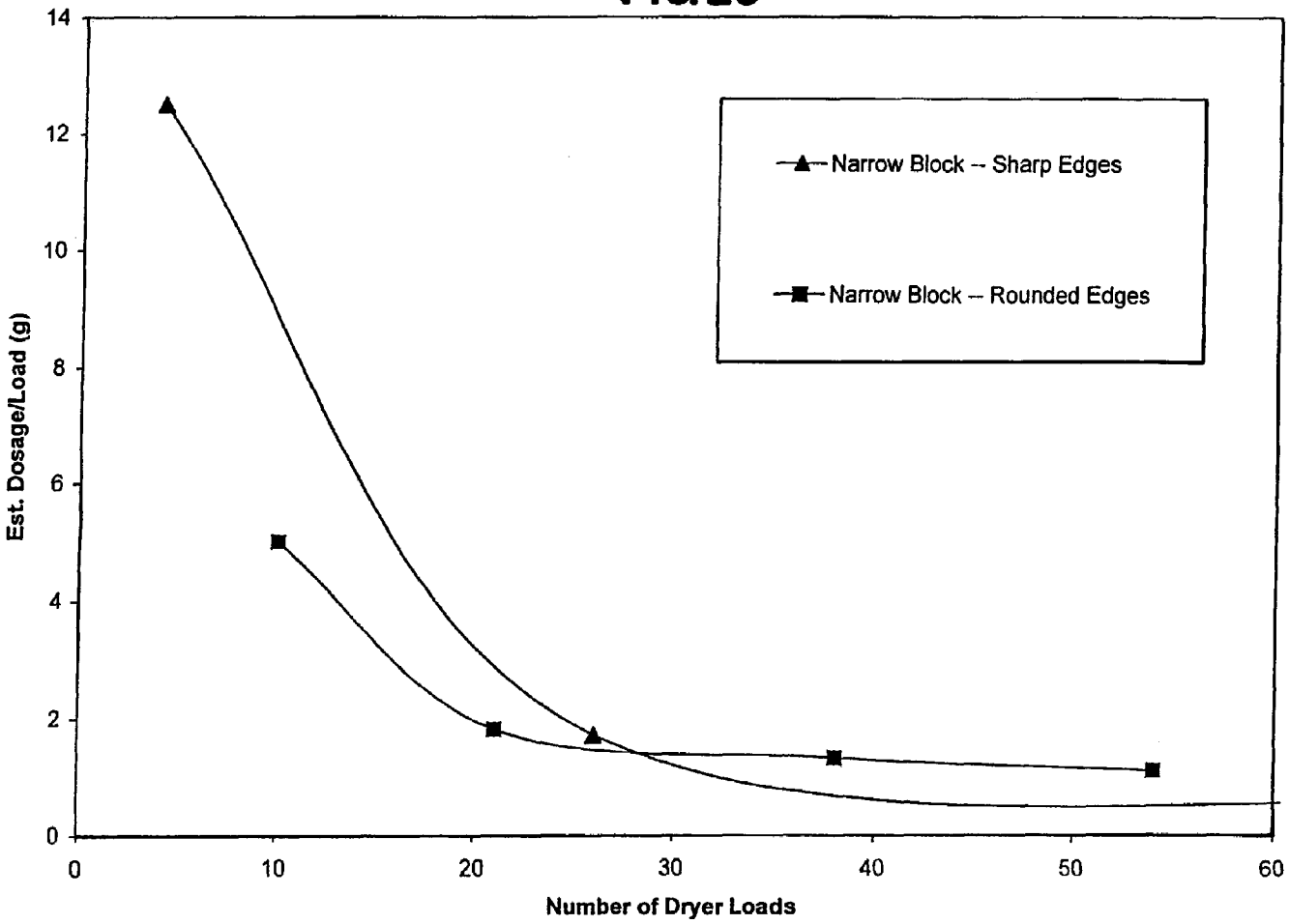
FIG. 20 is a graph showing the dispensing rates of the solid products shown in FIGS. 16*a* and 17*a;*
Figure 21:
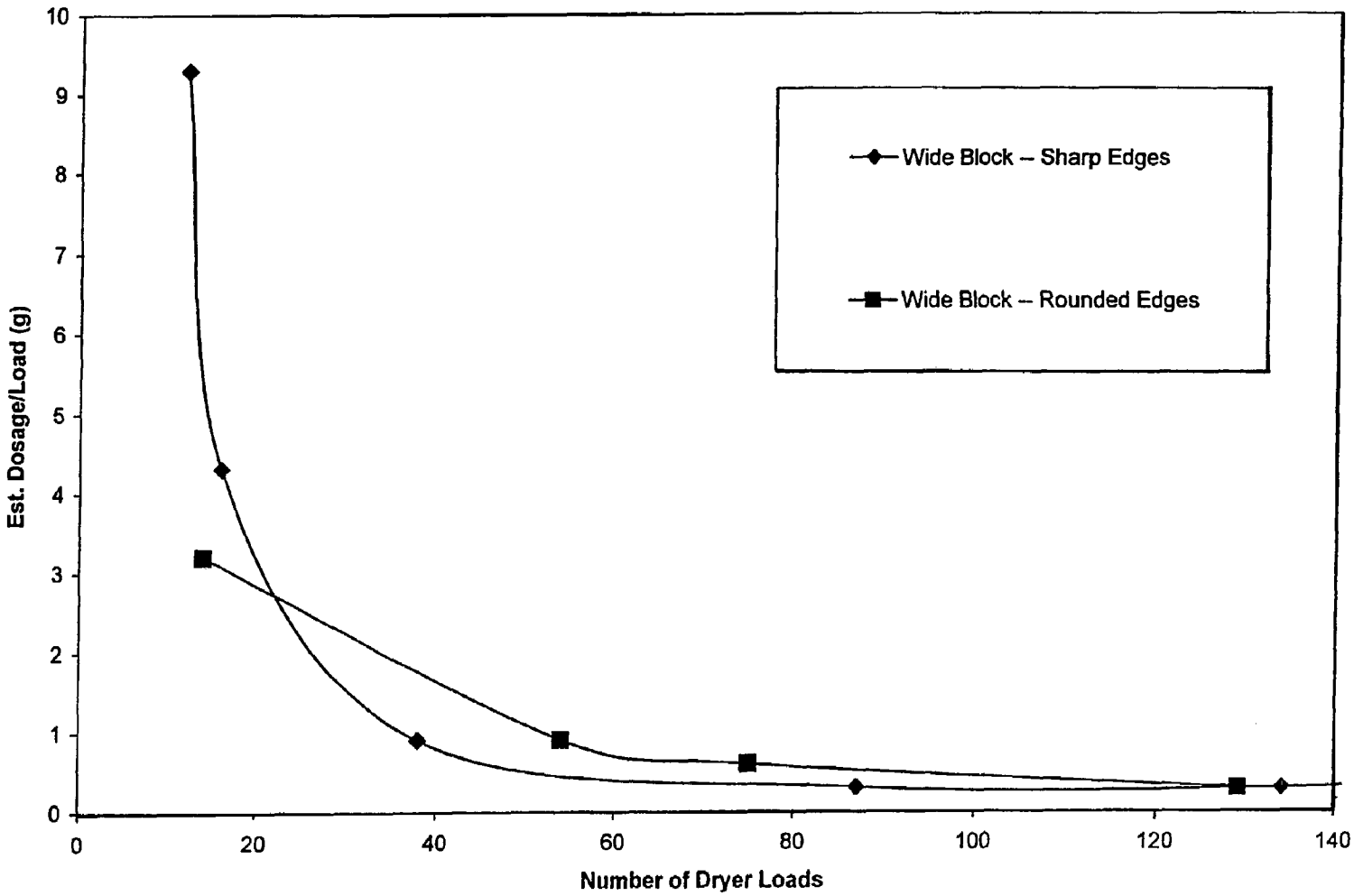
FIG. 21 is a graph showing the dispensing rates of the solid products shown in FIGS. 18*a* and 19*a;*

In operation, the paper 20 is peeled from the adhesive 19 operatively connected to the back side 18 of the plate member 11, and the adhesive 19 is applied to a surface such as a dryer fin 41 thereby operatively connecting the plate member 11 to the surface. Then, the product carrier 21 carrying product 31 is attached to the plate member 11. The attachment member 15 of the plate member 11 is configured and arranged to engage the mating member 24 of the product carrier 21. In the preferred embodiment, the attachment member 15 is a pair of holes on each side of the plate member 11 and the mating member 24 is a pair of hole plugs on each side of the product carrier 21 configured and arranged to releasably engage the holes. As described above, the hole plugs snap into the holes. When the product carrier 21 is attached to the plate member 11, the rail member 14 of the plate member 11 surrounds the edges and corners of the product carrier 21 thereby preventing items from getting caught or snagged on the edges and corners of the product carrier 21. The product 31 is then ready for dispensing. Only a small portion of the product 31 is depleted during each use. In the preferred embodiment fabric softener, approximately 1 to 3 grams of product is dispensed per cycle. Therefore, the product carrier 21 carrying the product 31 can be used for several applications. However, this amount of product will vary depending upon the type of product being dispensed, the chemical composition of the product, the size of the product, the size of the dryer, etc. Ideally, a consistent, optimum dose will be dispensed from the first cycle to the last cycle resulting in a relatively even dispense curve, as shown in FIGS. 20 and 21. When the product 31 becomes depleted, the empty product carrier 21 can be replaced with a second product carrier carrying product, and the empty product carrier 21 can be thrown away. Alternatively, the product carrier 21 could be removed if dispensing of the product 31 is not desired.

In another preferred embodiment, shown in FIGS. 8 and 9, the product dispenser and carrier 110 includes a mount 111 and a product carrier 121. The mount 111 is made of a high melt point plastic and is generally wedge shaped having dimensions of approximately 9⅜ inches long by 2⅜ inches wide and the first end 116 is ¼ inch thick and the second end 117 is ⅜ inch thick. Therefore, an end view of the mount 111 resembles a generally triangular shape with one side being thicker than the other, opposing side, forming an angle of approximately 10 degrees. The angle may vary depending upon the product to be dispensed to maximize the even dispensing of the product. The front side 112 includes an attachment member 115, which is a flange, proximate the first end 116 and the second end 117. The back side 118 includes an adhesive 119, similar to the adhesive 19 of the previously mentioned preferred embodiment, with paper backing 120.

The product carrier 121 has a first side 122, a second side 123, a first end 116, and a second end 117. Also made of a high melt point plastic, the dimensions of the product carrier are approximately 9⅜ inches long by 2⅜ inches wide by 3/16 inch thick. It is recognized that the dimensions are for illustrative purposes only and any dimensions suitable for the intended purpose are acceptable. The product carrier 121 is an extruded plastic part with dove tail grooves along the length of the product carrier 121 on the first side 122. The dove tail grooves 125 are approximately ⅛ inch deep. The dove tail grooves 125 hold the product 131 onto the first side 122 of the product carrier 121, in a similar fashion as the countersunk portions 26 hold the product 31 onto the product carrier 21. Also included on the product carrier 121 is mating member 124, which is a leg extending from each of the edges running along the length of the product carrier 121 to engage the flange 115 of the mount 111. The legs can either snap onto the flanges or the product carrier 121 may be slid onto the mount 111 to operatively connect the components. The product 131 is similarly cast or extruded onto the first side 122 of the product carrier 121 and held in place by the dove tail grooves 125. Because the mount 111 is wedge shaped, the product 131 is disposed at an angle relative to the surface upon which the mount 111 is operatively connected to maximize the amount of product 131 dispensed and to ensure that the product 131 is dispensed evenly.

In operation, the paper is peeled from the adhesive 119 operatively connected to the bottom side 118 of the mount 111, and the adhesive 119 is applied to a surface such as a dryer fin 141 thereby operatively connecting the mount 111 to the surface. Then, the product carrier 121 carrying product 131 is attached to the mount 111. The attachment member 115 of the mount 111 is configured and arranged to engage the mating member 124 of the product carrier 121. In the preferred embodiment, the attachment member 115 is a flange on each end 116 and 117 of the mount 111 and the mating member 124 is a pair of legs on each side of the product carrier 121 configured and arranged to releasably engage the flanges. The product carrier 121 may be either snapped onto the mount 111 so the legs engage the flanges or the product carrier 121 may be slid onto the mount 111 from the end of the mount 111. The product 131 is then ready for dispensing. The wedge shape of the mount 111 allows the product 131 to be more evenly dispensed because the product 131 is angled toward the center of the dryer 140 thereby exposing a greater surface area of the product 131 to the laundry contained within the dryer 140. Again, only a small portion of the product 131 is depleted during each use. Therefore, the product carrier 121 carrying the product 131 can be used for several applications. When the product 131 becomes depleted, the empty product carrier 121 can be replaced with a second product carrier carrying product, and the empty product carrier 121 can be thrown away. Again, the product carrier 121 could be removed if dispensing of the product 131 is not desired.

In another preferred embodiment product dispenser and carrier 210, shown in FIGS. 11*a* and 11*b*, the dispenser 211 includes an attachment member 215, which is a pair of oval shaped holes. The oval shaped holes ensure that the corresponding hole plugs, whether round or square, fit within the holes even if shrinkage of the holes during casting of the product (approximately up to 300° F.) or from the dryer heat (approximately up to 250° F.) should occur. The dispenser 211 also includes a front 212, a back 218, and a perimeter 213. The perimeter 213 of the dispenser 211 includes a rail portion 214 extending outward from the front 212 and an indentation 217. The rail portion 214 borders the carrier 221 and protects the edges of the carrier 221 when operatively connected to the front 212 of the dispenser 211. The indentation 217 provides easy access to a portion of the edges of carrier 221 when detachment from the dispenser 211 is desired. An adhesive, not shown, may be attached to the back 218 of the dispenser 211 for attaching the dispenser 211 to a surface.

The carrier 221 includes a first side 222, a second side 223, and a mating member 224. The first side 222 is the side onto which a solid product is cast or extruded, and the solid product extends outward from the first side 222. The first side 222 is dome shaped so that when the solid product is mounted thereto the solid product will take on a dome shape as well. In addition, the dome shape of the first side 222 creates deeper countersunk portions (not shown) proximate the second side 223 thereby allowing the product to attach more securely to the carrier 221. The dome shape also improves the dispense rate of the product and assists in more even dispensing of the product. Although not shown, the carrier 221 includes a plurality of apertures similar to those shown in FIGS. 13 and 14. This arrangement of the plurality of apertures allows the product to spread out from the first side 222 toward proximate the second side 223 thereby preventing the solid product from detaching from the carrier 221. The mating member 224 is a pair of square shaped hole plugs with arrow shaped ends and a slit parallel with the edges forming the arrow shaped ends. The mating member 224 corresponds with the holes in the dispenser 211. Because the hole plugs are square rather than round, there is more surface area engaging the holes thereby maximizing the grip. The hole plugs simply snap into the holes to releasably attach the carrier 221 to the dispenser 211.

Figure 12:
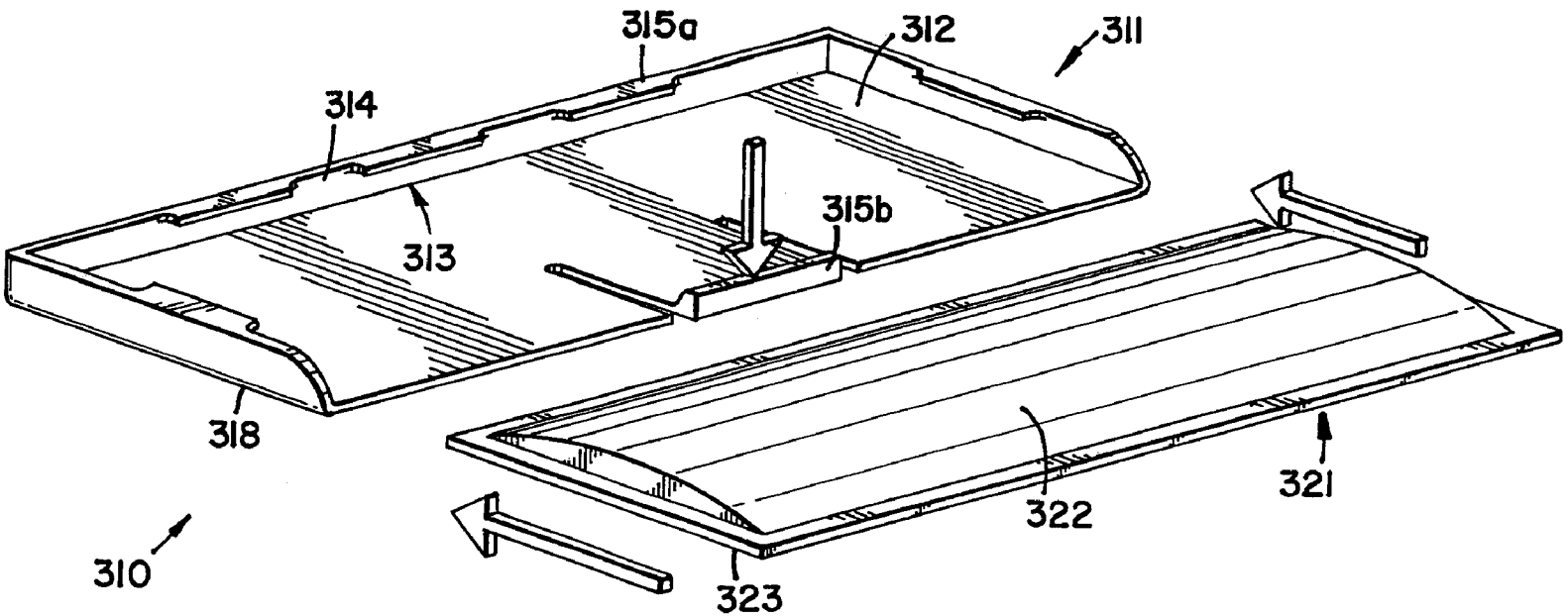
FIG. 12 is an exploded top perspective view of another embodiment product dispenser and carrier constructed according to the principles of the present invention.

FIG. 12 shows another preferred embodiment of the present invention. Rather than having an attachment member and a mating member that snap into one another, the product dispenser and carrier 310 includes a carrier 321 that slides into a dispenser 311. The carrier 321 itself acts as the mating member in this embodiment. The dispenser 311 has a front 312, a back 318, and a perimeter 313. The back 318 provides a surface on which an adhesive or other securing member may be attached to mount the product dispenser and carrier 310 onto a surface. The perimeter 313 of the dispenser 311 includes a rail portion 314 extending outward from the front 312 along three sides of the dispenser 311. The rail portion 314 borders the carrier 321 along three sides and protects the three edges of the carrier 321 when operatively connected to the front 312 of the dispenser 311. An attachment member includes lips 315*a* and a securing tab 315*b*. The lips 315*a* extend inward from the rail portion 314 to engage the three edges of the carrier 321 thereby preventing the carrier 321 from detaching from the dispenser 311. The securing tab 315*b* is on the fourth side of the dispenser 311 not having a rail portion. When the carrier 321 is slid into the dispenser 311 from the fourth side, the securing tab 315*b* is pushed downward and then snaps into place to border the corresponding edge of the carrier 321 when in place on the front 312 of the dispenser 311. Therefore, securing tab 315*b* provides a snap fit to hold the carrier 321 onto the dispenser 311. To disengage the carrier 321 from the dispenser 311, the securing tab 315*b* is pushed downward and then the carrier 321 is slid away from the dispenser 311 from the fourth side.

The second side 323 of the carrier 321 faces the front 312 of the dispenser 311 and the first side 322 of the carrier 321 is the side from which the product extends. Again, the first side 322 is dome shaped so that when the solid product is mounted thereto the solid product will take on a dome shape with rounded top edges as well. Again, this dome shape improves the dispensing rate of the product and assists in more even dispensing of the product. Although not shown, the carrier 321 includes a plurality of apertures similar to those shown in FIGS. 13 and 14. This arrangement of the plurality of apertures allows the product to spread out from the first side 322 toward proximate the second side 323 thereby preventing the solid product from detaching from the carrier 321.

Figure 13:
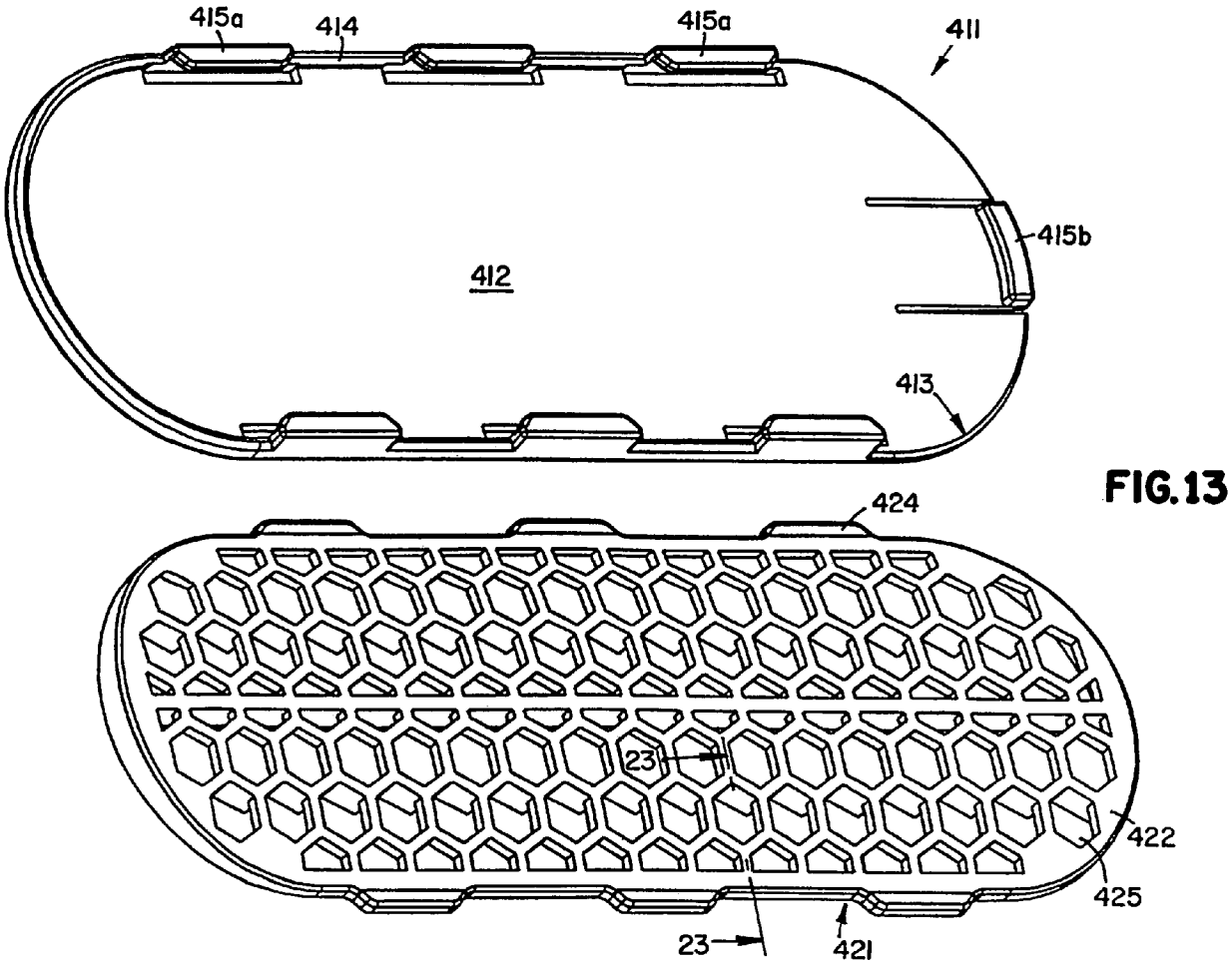
FIG. 13 is an exploded top perspective view of another embodiment product dispenser and carrier constructed according to the principles of the present invention.

FIG. 13 is another embodiment of the present invention similar to that shown in FIG. 12 but rather than sliding into the dispenser 411 from the side, the carrier 421 slides in from an end. The product dispenser and carrier 410 includes a dispenser 411 and a carrier 421. The dispenser 411 has a front 412 and a perimeter 413.

The perimeter 413 of the dispenser 411 includes a rail portion 414 extending outward from the front 412 along three sides of the dispenser 411, leaving an end without a rail portion. The rail portion 414 borders the carrier 421 along three sides and protects the corresponding three edges of the carrier 421 when operatively connected to the front 412 of the dispenser 411. An attachment member includes lips 415*a* and a securing tab 415*b*. The lips 415*a* extend from the rail portion 414 along the two sides, and in the preferred embodiment, there are three lips 415*a* on each side, the three lips 415*a* being aligned with the opposing three lips 415*a*. It is recognized, however, that any arrangement of lips 415*a* is possible as long as the mating members 424 on the carrier 421 are properly aligned. The securing tab 415*b* is on the end of the dispenser 411 not having a rail portion. When the carrier 421 is slid into the dispenser 411 from either the end or as described below, the securing tab 415*b* is pushed downward and then snaps into place to border the corresponding edge of the carrier 421 when in place on the front 412 of the dispenser 411.

The back (not shown) of the dispenser 411 provides a surface onto which an adhesive, magnet, or other attachment member may be attached to mount the dispenser 411 onto a surface. It is recognized that the attachment member may be attached to the entire back of the dispenser or a portion thereof. FIGS. 24*a* and 24*b* show embodiments having at least one magnet operatively connected to the back of the dispenser. The at least one magnet may be molded into the back in a channel-type setting thereby incorporating the magnet into the back of the dispenser, attached to the back of the dispenser with an adhesive, attached to the back of the dispenser with a fastener such as a screw, a pin, a stud, or a clamp. In FIG. 24*a*, a magnet 419' is incorporated into the back 418' of the dispenser and in FIG. 24*b*, two magnets 419" are incorporated into the back 418" of the dispenser. Any number of magnets may be operatively connected to the dispenser as long as the magnet(s) provide a strong enough attraction to the surface to hold the product dispenser and carrier in place during use.

The carrier 421 has a first side 422, a second side 423, and mating members 424. The mating members 424 are lips extending from the side edges of the carrier 421 and are arranged similarly as the lips 415*a* on the dispenser 411. Therefore, the carrier 421 does not have to be slid into the dispenser 411 all the way from an end of the carrier 421. Rather, the mating members 424 are simply placed in the spaces between the lips 415*a* thereby depressing the securing tab 415*b* concurrently. As the carrier 421 is slid into the dispenser 411 so that the lips 415*a* align with the mating members 424, the securing tab 415*b* engages the end of the carrier 421 thereby snap locking it into place. This provides a shorter distance to connect the carrier 421 to the dispenser 411 should the walls of the dryer prevent the carrier 421 from being slid into place from the end of the dispenser 411. To disengage the carrier 421 from the dispenser 411, the securing tab 415*b* is pushed downward and then the carrier 421 is slid away from the lips 415*a* of the dispenser 411. When the mating members 424 of the carrier 421 no longer align with the lips 415*a* of the dispenser 411, the carrier 421 may be removed from the dispenser 411.

The carrier 421 also includes a plurality of apertures 425 and tapered portions 426. The tapered portions 426 taper outward from the first side 422 to the second side 423 of the carrier 421, and the tapered apertures 425 have a smaller diameter on the first side 422 and a larger diameter on the second side 423. The preferred embodiment apertures 425 are hexagonal shaped, and each of the six sides is tapered. In the preferred embodiment, the tapered portions 426 are angled more than 0° and less than 10° from a tangent line generally perpendicular to the first side 422 of the carrier 421. More preferably, the tapered portions 426 are tapered approximately 1° to 3° from a tangent line generally perpendicular to the first side 422 of the carrier 421. FIG. 23 shows a cross sectional view of an aperture 425 in the carrier 421 taken along the lines 23-23 in FIG. 13. The apertures 425 have tapered portions 426 with angles A. Similar to the countersunk portions described above, angles A provide means to secure the solid product onto the carrier 421 because the solid product slightly fans out proximate the second side 423 thereby securing the solid product onto the carrier 421.

In any of the embodiments, either tapered portions or countersunk portions may be used as they have the same function. The tapered portions begin at the top of the carrier and taper outward toward the bottom of the carrier. In the countersunk portions, the taper begins approximate the middle of the carrier and taper outward toward the bottom of the carrier. Regardless where the taper begins, the taper allows the solid product to fan out proximate the bottom of the carrier thereby securing the solid product onto the carrier.

Figure 14:
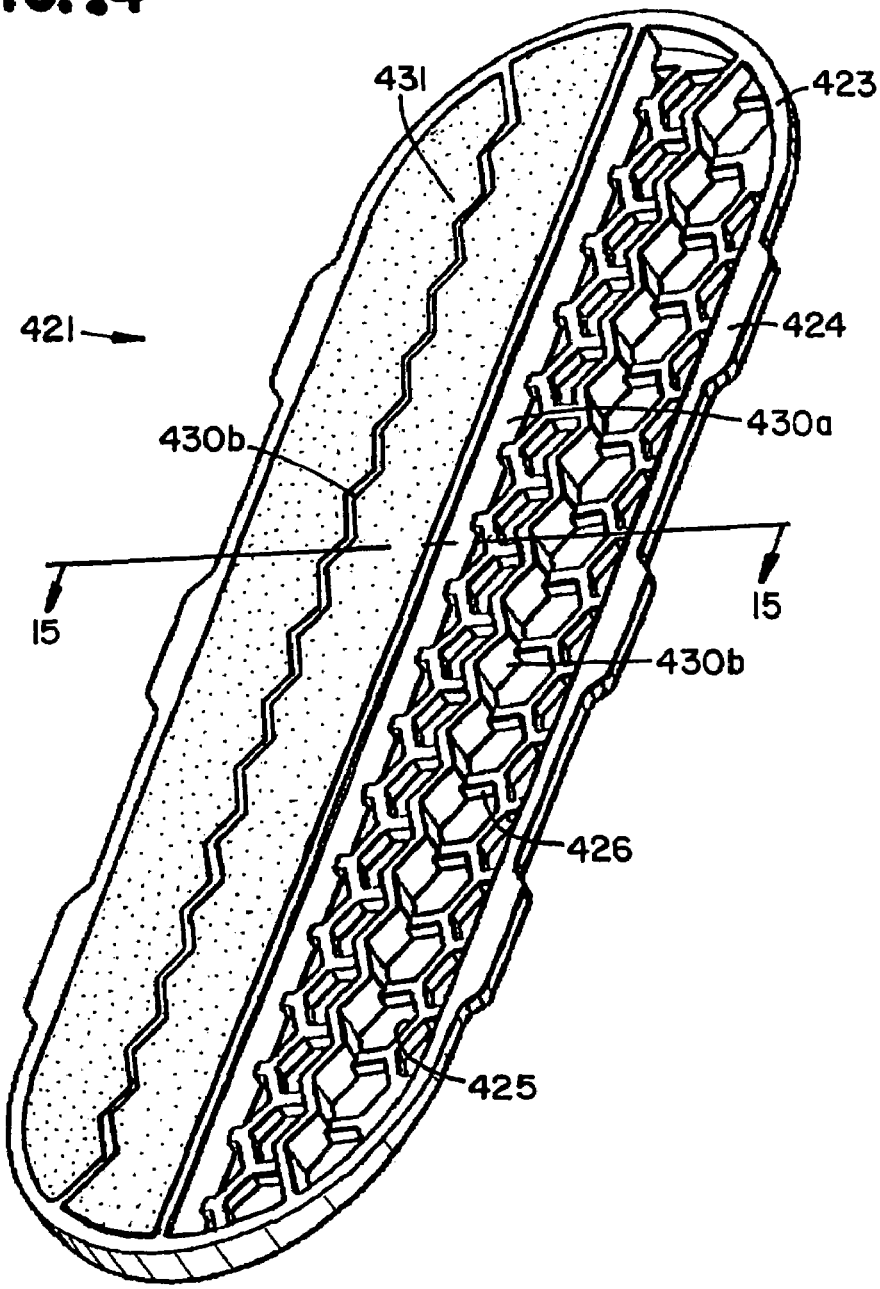
FIG. 14 is a bottom perspective view of the carrier shown in FIG. 13 with a product operatively connected to half of the carrier.

FIG. 14 is a bottom perspective view of the carrier 421 shown in FIG. 13. For illustrative purposes, product 431 is only shown on half of the carrier 421 to show both the bottom structure of the carrier 421 and how the product 431 is supported below the carrier 421. As shown in FIG. 14, the carrier 421 includes a straight reinforcement rib member 430*a* along the center parallel to the sides of the carrier 421 and a zig-zag reinforcement rib member 430*b* on each side of the straight reinforcement rib 430*a* approximately halfway to the sides of the carrier 421. The zig-zag reinforcement members 430*b* do not interfere with the nonlinear arrangement of the apertures 425 and therefore do not block the apertures 425. The zig-zag reinforcement members 430*b* may or may not be tapered or countersunk to hold the product in a similar way as the apertures 425 of the carrier 421. There is a major portion of the product 431 on the top of the carrier 421 to be dispensed during the dryer cycle. There is a minor portion of the product 431 inside the carrier 421 and extending into the tapered portions 426 and in between the ribs 430*a* and 430*b* of the carrier 421, as shown in FIG. 14. Therefore, the major portion of the product is joined on top of the carrier 421 and the minor portion of the product is joined below the carrier 421 between the ribs 430*a* and 430*b*. This assists in keeping the product on the carrier 421.

Figure 15:
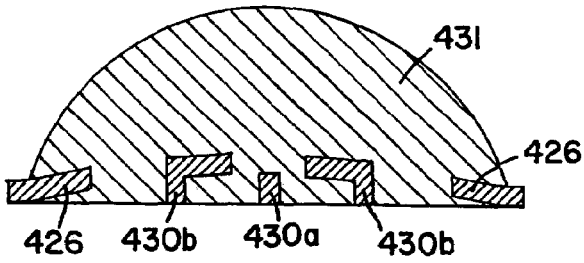
FIG. 15 is a cross sectional view of a solid product on the product carrier taken along the line 15-15 of FIG. 14.

Optionally, the carrier 421 may also include a cover (not shown) attached to the second side 423 and creating a gap between the second side 423 and the cover where the product joins below the carrier 421. With a cover, the product 431 would contact the cover between the ribs 430*a* and 430*b*. This assists in casting the product vertically onto the carrier 421 and the product is more evenly applied to the carrier 421. When casting the product onto the carrier 421 horizontally, the cover is not needed for even application of the product. Also, the cover protects the solid product that has gone through the apertures and tapered portions so the only part of the product that is exposed is the portion extending from the first side 422 of the carrier 421. Therefore, the product can extend past the tapered portions 426 and reconnect/join along the surface of the cover to provide additional assurance that the product will not separate from the carrier 421. The line 15-15 in FIG. 14 shows the line across which the cross sectional view of FIG. 15 is taken. FIG. 15 is a cross sectional view showing a solid product 431 on the carrier 421 shown in FIGS. 13 and 14. Although FIG. 14 shows product 431 on only half of the carrier 421, FIG. 15 shows product on the entire carrier 421. This further shows how the product 431 connects both above and below the carrier 421 for added security of the product 431 on the carrier 421.

Figure 22:
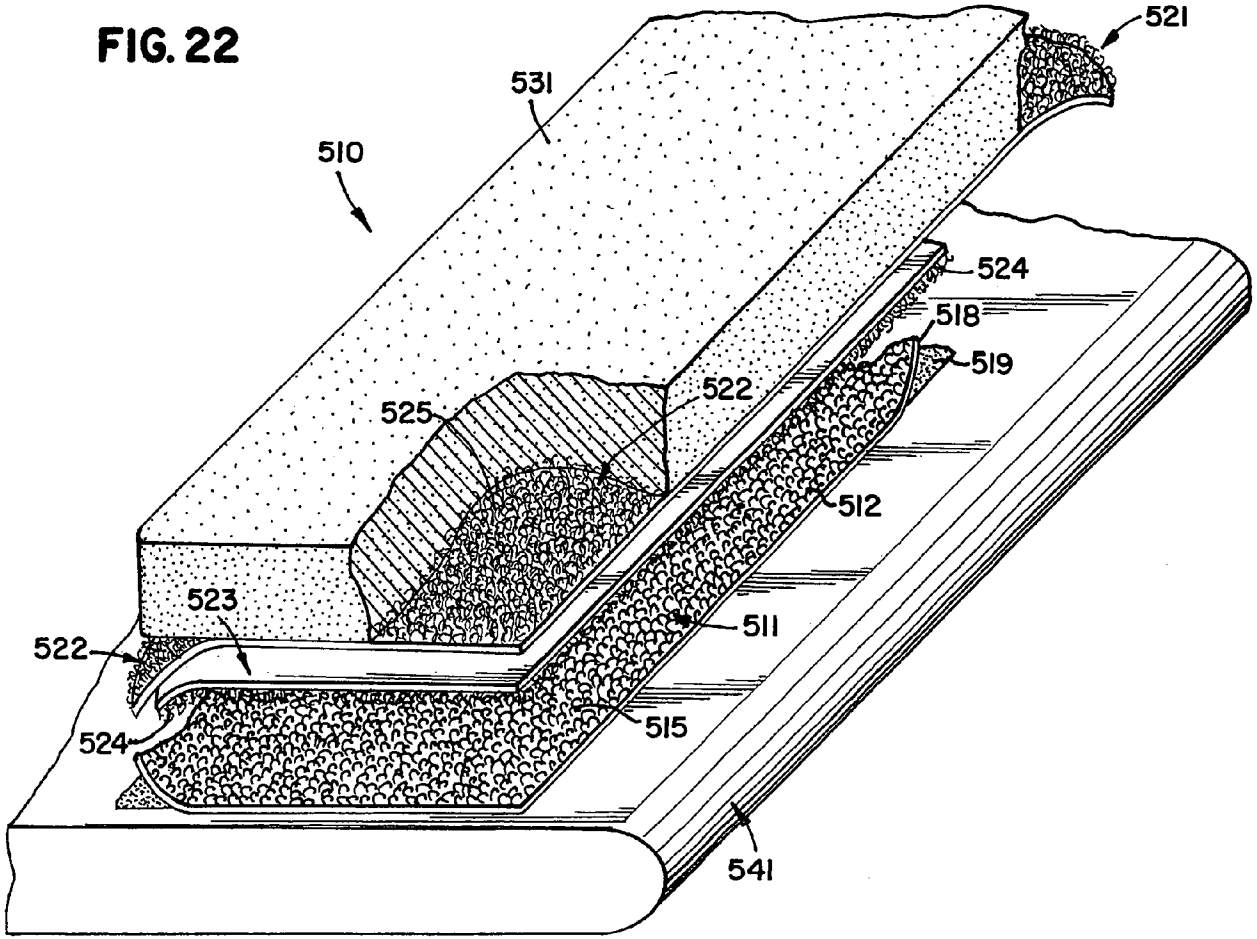
FIG. 22 is an exploded side perspective view of another embodiment product dispenser and carrier constructed according to the principles of the present invention.

In addition, the product could also be mounted, cast, or otherwise attached by means well known in the art onto VELCRO®, 3M™ Scotchmate™, 3M™ Dual Lock™, or any other suitable hook and loop or reclosable fastener type device. FIG. 22 shows a preferred embodiment product dispenser and carrier 510 utilizing hook and loop. The product dispenser and carrier 510 includes a dispenser or plate member 511 and a carrier 521. The dispenser 511 is a piece of loop having a front 512 with an attachment member 515 and a back 518 with an adhesive or connecting member 519. The adhesive 519 operatively connects the dispenser 511 onto a surface such as a dryer fin 541. The carrier 521 includes a first side or layer 522 and a second side or layer 523. The first and second sides 522 and 523 are each pieces of hook, and the adhesives attached to the back of each piece (not shown) are pressed together so that the hook portions are opposing. The first side 522 has hook 525 and the second side 523 has hook or mating member 524. The product 531 is attached to the hook 525 while the mating member 524 engages the attachment member 515. Therefore, the carrier 521 readily attaches to and detaches from the dispenser 511 as easily as the interaction between the hook 524 and the loop 515. When the product 531 has become depleted, the carrier 521 is simply detached from the dispenser 511 by disengaging the hook 524 and the loop 515 and then another carrier carrying product is substituted therefor.

Figure 25:
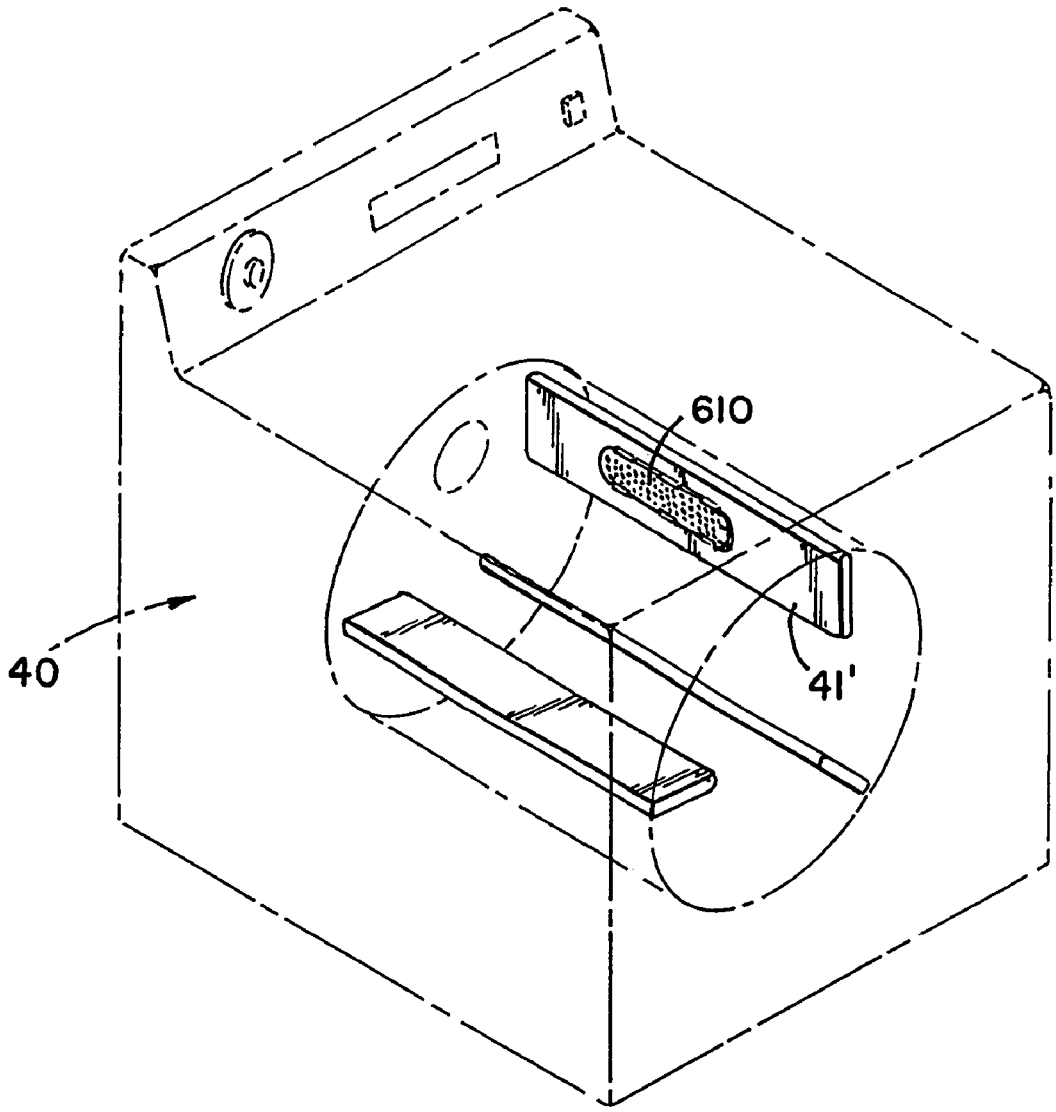
FIG. 25 shows another embodiment product dispenser and carrier constructed according to the principles of the present invention operatively connected to a dryer fin.

Another embodiment of the present invention incorporates the dispenser or plate member 611 of the product dispenser and carrier 610 into an inner surface of the dryer 40. The plate member may be molded as part of the inner surface of the dryer 40 or fixedly attached thereto by means well known in the art. FIG. 25 shows the dispenser 611 incorporated into the fin 41' of the dryer 40. However, the inner surface of the dryer could be a fin, a door, a wall opposite the door, and a drum wall of the dryer; and there are many possible locations and orientations of the plate member on these surfaces.

Figure 26:
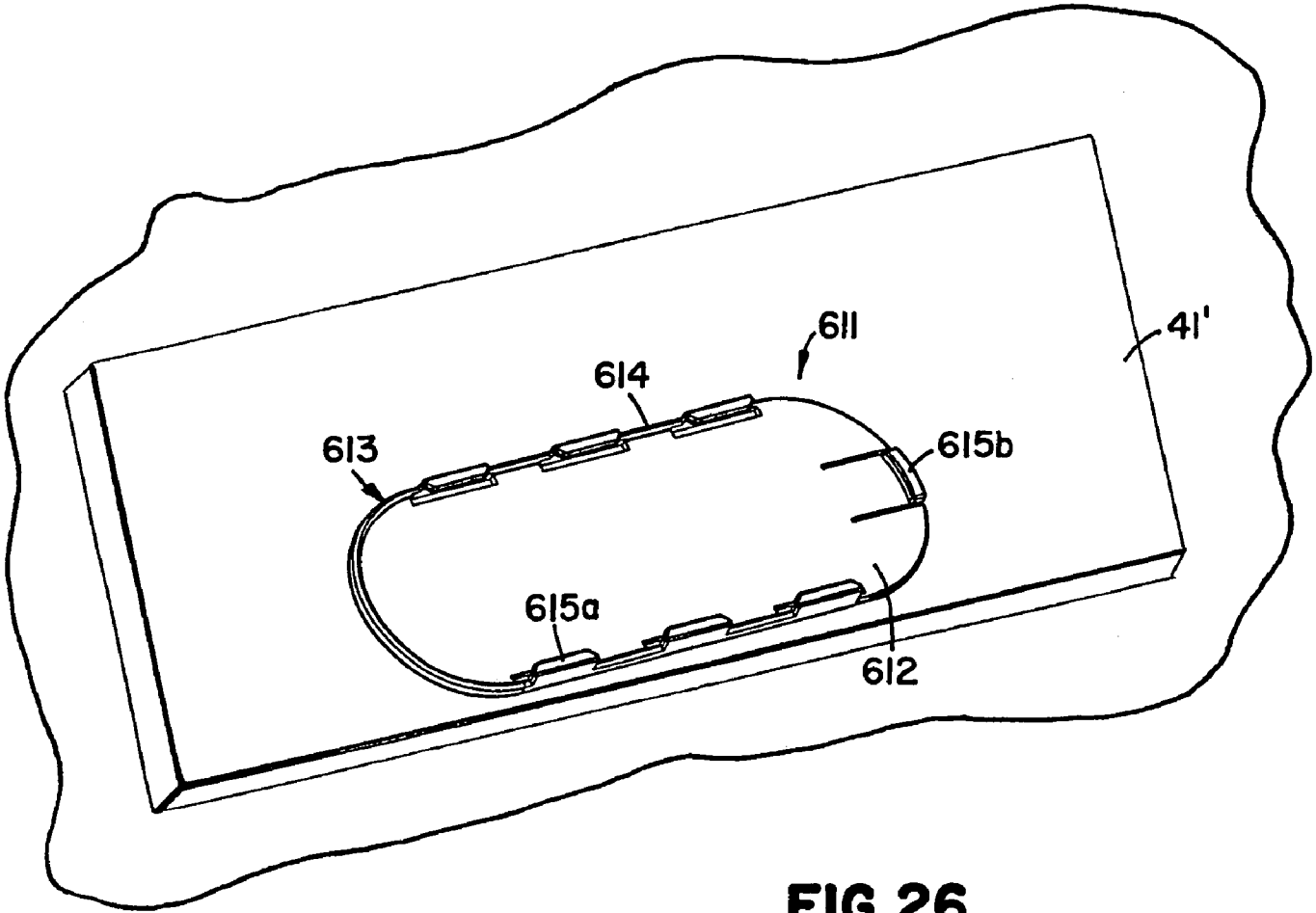
FIG. 26 is a top perspective view of a dispenser of the product dispenser and carrier of FIG. 25 incorporated into the dryer fin.

As shown in FIG. 26, the dispenser 611 of the product dispenser and carrier 610 includes a front side 612 and a perimeter 613. The perimeter 613 of the dispenser 611 includes a rail portion 614 extending outward from the front 612 along three sides of the dispenser 611, leaving an end without a rail portion. Alternatively, rather than having a rail portion, one end could include a stop member and the opposite end could receive the product carrier (not shown). Similar to the product dispenser and carrier 410 shown in FIG. 13, the rail portion 614 borders the product carrier along three sides and protects the corresponding three edges of the product carrier when operatively connected to the front 612 of the dispenser 611. An attachment member includes lips 615*a* and a securing tab 615*b*. The lips 615*a* extend from the rail portion 614 along the two sides, and in the preferred embodiment, there are three lips 615*a* on each side, the three lips 615*a* being aligned with the opposing three lips 615*a*. It is recognized, however, that any arrangement of lips 615*a* is possible as long as the mating members on the carrier (not shown) are properly aligned. The securing tab 615*b* is on the end of the dispenser 611 not having a rail portion. When the carrier is slid into the dispenser 611 from either the end or as described above with regard to the product dispenser and carrier 410, the securing tab 615*b* is pushed downward and then snaps into place to border the corresponding edge of the carrier when in place on the front 612 of the dispenser 611.

Although only one embodiment of the present invention is shown incorporated into the dryer fin 41', it is recognized that any of the embodiments shown and described could be similarly incorporated or even fixedly attached thereto. In addition, attachment members could simply be incorporated into the inner surface of the dryer to receive and secure the product carrier onto the inner surface.

Figure 16A:
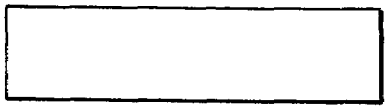
FIG. 16*a* is a side view of a solid product having a half-cylindrical narrow shape and a high dome.
Figure 16B:
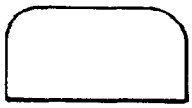
FIG. 16*b* is an end view of the solid product shown in FIG. 16*a;*
Figure 17A:
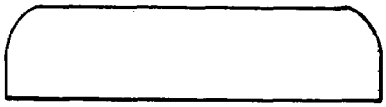
FIG. 17*a* is a side view of a solid product having a half-cylindrical narrow shape and a high dome with rounded top edges.
Figure 17B:
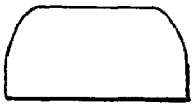
FIG. 17*b* is an end view of the solid product shown in FIG. 17*a;*
Figure 18A:
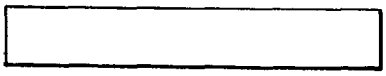
FIG. 18*a* is a side view of a solid product having a half-cylindrical wide shape and a low dome.
Figure 18B:
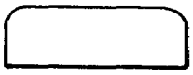
FIG. 18*b* is an end view of the solid product shown in FIG. 18*a;*
Figure 19A:
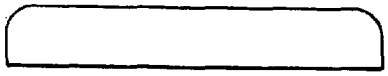
FIG. 19*a* is a side view of a solid product having a half-cylindrical wide shape and a low dome with rounded top edges.
Figure 19B:
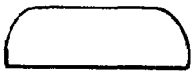
FIG. 19*b* is an end view of the solid product shown in FIG. 19*a;*

It was found that the shape of the product affects the dispensing rate of the product. The dispense curves of the product dose per dryer cycle as a function of the number of dryer cycles were compared for four different sizes and shapes of solid product. Each solid product was 8 inches long. The dispenser and carriers were mounted in the center on the front portion of the fin of a 75 pound dryer. The front portion of the fin is the portion that touches the laundry. The first product having a half-cylindrical narrow shape (1.75 inches wide) and a high dome (1.00 inch high) is shown in FIGS. 16*a* and 16*b*. FIG. 16*a* is a side view of the product and FIG. 16*b* is an end view of the product shown in FIG. 16*a*. The second product having a half-cylindrical narrow shape (1.75 inches wide) and a high dome (1.00 inch high) with rounded top edges is shown in FIGS. 17*a* and 17*b*. FIG. 17*a* is a side view of the product and FIG. 17*b* is an end view of the product shown in FIG. 17*a*. The third product having a half-cylindrical wide shape (2.50 inches wide) and a low dome (0.65 inch high) is shown in FIGS. 18*a* and 18*b*. FIG. 18*a* is a side view of the product and FIG. 18*b* is an end view of the product shown in FIG. 18*a*. The fourth product having a half-cylindrical wide shape (2.50 inches wide) and a low dome (0.65 inch high) with rounded top edges is shown in FIGS. 19*a* and 19*b*. FIG. 19*a* is a side view of the product and FIG. 19*b* is an end view of the product shown in FIG. 19*a*.

The wide, low dome products (third and fourth products) shown in FIG. 21 dispensed the product more slowly than the narrow, high dome products (first and second products) shown in FIG. 20. The initial doses were approximately 9 grams and 3.5 grams per dryer cycle (third and fourth products, respectively) versus approximately 13 grams and 5 grams per dryer cycle (first and second products, respectively). The products with the rounded top edges (second and fourth products) dispensed the product more evenly from the first to the last cycle as compared to the products with squared/sharp edges (first and third products). In other words, the high initial doses observed with squared/sharp edges (first and third products) were avoided by rounding the edges (second and fourth products). These high initial doses are most likely due to the wet laundry sliding over the square/sharp edges at both ends of the half-cylindrical product thereby slowly wearing the edges until a rounded edge is formed. The optimum shape for even dispensing of the product was obtained by using a half-cylindrical block of product with squared/sharp edges that were rounded after approximately 20 dryer cycles. Therefore, starting with a shape having rounded edges or rounded surfaces, which results from using a block of product with squared/sharp edges that were rounded after approximately 20 dryer cycles, provides an optimum shape for dispensing a consistent, optimum dose of product. The optimum shape helped reduce high product doses in the initial doses. As shown in FIGS. 20 and 21, the most even dispensing was achieved with the wide product block with rounded edges (fourth product).

FIG. 20 is a graph showing the dispensing rates of the solid products shown in FIGS. 16*a* and 17*a*, and FIG. 21 is a graph showing the dispensing rates of the solid products shown in FIGS. 18*a* and 19*a*. These graphs show that products having rounded edges have more even dispense curves from the first dose to the final dose. The products having the sharp edges begin with much higher initial doses than products having rounded edges. Therefore, to ensure that a consistent, optimum dose is achieved for each cycle, a product with rounded edges should be used.

The amount of product dispensed is also moisture controlled. In other words, every time the wet or damp laundry tumbling around in the dryer contacts the product, minute amounts of the product are dissolved by the adsorbed water in the laundry. This is due to the low water solubility of the product and also due to the friction (mechanical action) of the laundry rubbing against the product. Once the laundry is dry, product will no longer be dispensed. In the preferred embodiment, the product is sized to deliver doses for multiple cycles (100+). Ideally, the dose should not change significantly from the first to the last dryer cycle. For example, if a dose of 1 gram per cycle provides the desired effect on the laundry, a block of 100 grams should last for 100 cycles, dispensing approximately 1 gram per cycle. Generally, the product will last for multiple cycles (100+) in a dryer and dispense approximately the same dose of product from the first to the last cycle.

However, experiments have shown that dispense curves are not even from the first to the last cycle because of the changes in volume, surface area, and shape of the product over time. The changes in the volume and the surface area, which inevitably decrease with each dose, cause the dispensed dose to decrease slowly from the first to the last cycle because there is less contact with the laundry and the product. The shape of the product is also a factor for the initial doses of the product. If the product is cast in the shape of a rectangular block, the contact between the tumbling laundry and the block will cause the sharp edges of the block to become smooth or round by friction during the initial cycles. This causes substantially higher dispense doses in the initial dryer cycles until the edges are smooth or round and the block resembles a half-cylinder with round ends (oval in shape).

In addition, the amount of product that is dispensed can also be affected by the location, the position, and the orientation of the product in the dryer. The product can be placed on either side of the fin or even on the door of the dryer. In addition, it was found that placement of the dispenser and carrier on the fin also affects the dispensing rate of the product. In other words, placing the dispenser and carrier on the side of the fin that touches the laundry would increase the dispensing rate of the product. Conversely, placing the dispenser and carrier on the side opposite the side of the fin that touches the laundry would decrease the dispensing rate of the product. Position on the fin such as in the center of the fin or near the edge of the fin will also affect the dose. In addition, if the product is mounted at an angle relative to the surface of the fin, as shown in FIG. 9, more product is exposed to the laundry thereby dispensing more product. Although any of these placements is acceptable, it is preferred to place the dispenser and carrier on the back side of the fin (the following edge) to dispense less product, which provides better results.

It is understood that any of these features may be interchanged among the different preferred embodiments to create variations thereof and such variations are within the scope of the present invention. It is also understood that the plate member and the product carrier may be made in numerous different shapes and sizes and are not limited to being rectangular or oval in shape, as shown in the preferred embodiments. Further, it is recognized that the dimensions described herein are for illustrative purposes only and any dimensions suitable for the intended purpose are acceptable. In addition, it is also understood that the product dispenser and carrier may be used on the inner surface of a dryer or it may even be used in different applications such as pest elimination and dish washing to dispense products such as insect bait and drying agents, respectively. Also, the types of products that could be used with this device are softeners, sanitizers, water repellants, deodorizers, bleaches, soil repellants, dye-transfer inhibitors, fiber protecting polymers, fiber smoothers, UV light absorbers, anti-wrinkle agents, etc. Any of these products, as well as additional products, could be used with the present invention.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A dispensing system for dispensing a fabric conditioner, comprising:

a) a dryer having an inner surface;

b) a plate member incorporated into said inner surface, said plate member having a front side;

c) an attachment member operatively connected to said front side of said plate member;

d) a product carrier having a mating member configured and arranged to engage said attachment member thereby releasably connecting said plate member and said product carrier, said product carrier including voids; and e) a solid fabric conditioner filling said voids to secure said solid fabric conditioner to said product carrier, a substantial portion of said solid fabric conditioner extending from said product carrier and being exposed proximate said inner surface.

2. The dispensing system of claim 1, wherein said inner surface is a fin.

3. The dispensing system of claim 1, wherein said attachment member is a hole and said mating member is a hole plug configured and arranged to releasably engage said hole.

4. The dispensing system of claim 1, wherein said attachment member is lips and a securing tab and said mating member is said product carrier, said product carrier being engaged by said lips and said securing tab to secure said product carrier thereto.

5. The dispensing system of claim 1, wherein said attachment member is first lips and a securing tab and said mating member is second lips.

6. The dispensing system of claim 1, wherein said attachment member is loop and said mating member is hook.

7. The dispenser of claim 1, wherein the voids are voids in the product carrier selected from the group consisting of a plurality of apertures and a plurality of dove tail grooves.

8. The dispenser of claim 1, further comprising a connecting member extending outward from said product carrier, said connecting member having a first end and a second end, said first end being operatively connected to said product carrier, said voids being between said product carrier and said second end of said connecting member.

9. The dispenser of claim 8, wherein said connecting member is a connecting member selected from the group consisting of a plurality of hooks and a plurality of grips.

10. The dispenser of claim 1, wherein the voids are a plurality of apertures in the product carrier.

11. The dispenser of claim 10, wherein the plurality of apertures are at least partially tapered proximate said second side of the product carrier.

12. The dispenser of claim 1, wherein the solid fabric conditioner is cast onto said product carrier.

13. The dispenser of claim 1, wherein the solid fabric conditioner is extruded onto said product carrier.

* * * * *